US005517404A

United States Patent [19]

Biber et al.

[11] Patent Number: 5,517,404

[45] Date of Patent: May 14, 1996

[54] PROCESS CONTROL IN THE TEXTILE PLANT

[76] Inventors: Heinz Biber, Buelstrasse 28, CH-8356 Ettenhausen; Urs A. Meyer, Obermattstrasse 9, CH-8153 Rumlang; Urs Meyer, Hohfurristrasse 1, CH-8172 Niederglatt, all of Switzerland

[21] Appl. No.: 927,307

[22] PCT Filed: Jan. 21, 1992

[86] PCT No.: PCT/CH92/00014

§ 371 Date: Nov. 20, 1992

§ 102(e) Date: Nov. 20, 1992

[87] PCT Pub. No.: WO92/13121

PCT Pub. Date: Jun. 8, 1992

[30] Foreign Application Priority Data

Jan. 23, 1991 [CH] Switzerland ..... 00 189/91
Apr. 5, 1991 [CH] Switzerland ..... 01 025/91

[51] Int. Cl.[6] ..... G05B 15/02

[52] U.S. Cl. ..... 364/138; 364/470; 57/264

[58] Field of Search ..... 364/470, 131–139; 57/264; 19/65 A, 97.5, 105; 66/218, 163

[56] References Cited

U.S. PATENT DOCUMENTS 4,835,699 5/1989 Mallard ..... 364/470
4,876,769 10/1989 Schlepfer et al. ..... 19/105
4,928,353 5/1990 Demuth et al. ..... 19/105
4,940,367 7/1990 Staheli et al. ..... 19/105
5,046,013 9/1991 Ueda et al. ..... 364/470
5,161,111 11/1992 Oehler et al. ..... 364/470
5,225,988 7/1993 Barea ..... 364/470

*Primary Examiner*—James P. Trammell

[57] ABSTRACT

A spinning mill with a master process control computer for at least one group of machines, whereby each machine of the group is provided with its own machine control unit which controls the actuators of the machine (including any auxiliary aggregates allocated to the machine). At least one network is provided for bidirectional communication between the computer and each machine of the group. During the operation of the plant, master control instructions from the process control computer are supplied via the network to the machine control units. Each machine control unit forwards the control instructions to the actuators controlled by the machine control unit, whereby the control instructions, if required, are converted by the machine control unit into control signals which are suitable for the actuators.

31 Claims, 18 Drawing Sheets

PROCESS CONTROL IN THE TEXTILE PLANT

The invention relates to a process control system, in particular for spinning mills.

STATE OF THE ART

The idea of a computer-controlled spinning mill has been in the minds of experts for at least twenty years (see for example: U.S. Pat. No. 3,922,642; BE 771277; BE 779591).

The efforts undertaken in this direction have risen manifold within the last few years (see for example: DE-OS 3906508; U.S. Pat. Nos. 4,563,873; 4,665,686; EP-PS 0410429).

The intermediate stage on the way to a process control system was process data acquisition, which appeared in 1980. This was described, for example, in the article "Die Prozessfatenerfassung als Fhrungsinstrument" (Process Data Acquisition as Guidance Instrument") by W. Kistler, which appeared in "Textil Praxis International" in May 1984. The further development of process data acquisition can be traced by the following articles:

i) Mikroelektronik—heutige und zukünftige Einsatzgebiete in Spinnereibetrieben"

("Microelectronics—Present and Future Fields of Application in Spinning Mills") by Marcel Zünd in "Melliand Textilberichte", June 1985;

ii) Zellweger Uster: "Conedata 100 for Quality and Productivity in Winding", published in "Textile World", April 1986;

iii) "A Quality Analysis System for OE Based on an Absolute Detector" by Dan Claeys, published in the "Canadian Textile Journal" of May 1986, which outlines the "downloading" of settings for slub catchers.

The Reutling spinning colloquium held in December 1986 was dedicated to the computer sciences. General deliberations about the use of process control systems in spinning were presented such as, for example, in the article "Integration of Information in Textile Plants—Considerations on Textile CIM" (Dr. T. Fischer).

The requirements that an information system has to meet were outlined in the article "Integrated Information Processing as Instrument of the Management", published in Melliand Textile Reports, November 1987, page 805 to 808. First ideas for up-to-date solutions are shown in the article "Integration and Networking Capabilities in Textile Production by CIM", page 809 to 814 of said publication.

The BARCO CIM system may be quoted as being the state of the art in January 1991. This system was disclosed in the publication "CIM in spinning" of Barco Automation, Inc., Charlotte, N.C., U.S.A. It provides one "data unit" (machine terminal) per machine, whereby the process control computer (the main frame) exchanges signals with the data units of the machines. The data unit (with its displays) also provides operator support. Although the above-mentioned publication mentions bidirectional communication, the system is obviously primarily designed for data acquisition in the machine and advancement of data to the process computer. A connection with the machine controls is neither shown nor indicated. Such data units can be integrated into a single network, which simplifies the system architecture—possibly at the expense of system flexibility and reaction speed. Moreover, as no true central control is provided by the system, there are no measures taken to protect the machine connected to the network from the effects of a network failure or breakdown. A further development of this system is disclosed in the article "Yarn breakage detector for ring spinning machines", published in Melliand Textile Reports in September 1991 (ITMA Edition).

In certain fields of industry, process control systems have long been introduced as state of the art. The question arises as to why these "known principles" cannot be realized without any additional efforts in the spinning mill. Instead, the implementation requires considerable efforts and is carried out step by step. The answer is that this is partly due to the fact that it is very difficult to "impose" a process control system on a machine complex (such as a spinning mill, for example). Process control systems can be introduced fairly easily whereever data processing and process technology were developed simultaneously. This is more the case, for example, in the field of manmade fiber preparation (filament spinning), so that it was possible to agree on the introduction of process control systems in filament spinning as early as the Dornbirn conference of 1981 (lecture of K. Ibonig—"Changes in Process Control Technology by Microeletronics").

The technology of short-stapled and long-stapled fiber spinning as well as the design of the machines for such spinning mills cannot be changed quickly. Data processing has to be adjusted to a slower course of development of the process. A proposal for a process control system that can be realized in a spinning mill must take into account the circumstances that prevail in the spinning mill. The aspects affecting the process control system will therefore briefly be explained below.

DATA PROCESSIING/PROCESS TECHNOLOGY (AUTOMATION)

Data processing that is applied to a spinning mill is embedded within the overall framework of automation. Its purpose is the improved control over the yarn production. The measuring factors are the production costs. The side conditions are determined by the market for raw materials, the local operational conditions and the yarn purchasers. The following information relates to the conditions in the spinning of short-stapled fibers. The ring spinning of a yarn made of combed cotton serves as an example. The invention, however, is also applicable to other spinning mills and to producing other final products.

The spinning process comprises the transformation of a natural product with properties that can be predetermined within certain limits into a precisely specified intermediate product (yarn). By its division into a number of different stages the production of yarn is particularly sophisticated with respect to the process technology involved.

As is shown in FIG. 1, the creation of value (quality) is not distributed evenly among the spinning process stages: In the blowing room and the carding room the cleaning effect is in the foreground, which has a substantial influence on the running properties in the subsequent spinning of the fibers. The strongest impact on the properties of the finished yarn is made by the subsequent process stages of combing and drawing. They are used to finish the raw material and to even out the fiber structure. These sections within the production only form a limited part of the creation of value in present spinning. However, they are decisive for controlling the process. The potential benefit is primarily limited to the exploitation of inexpensive raw materials. The majority of the creation of value (quality) lies in the final spinning process. The yarn with the precisely defined quality is produced in this stage. At the end of the final spinning the material is tested and evaluated as "good" or "low quality" (or even "reject").

A further investigation of the creation of value has shown that the highest potential for improvement lies in the manpower requirements. The ring spinning process is a particularly good example for this. FIG. 2 shows the manpower requirements in the various processing stages. Operating does not require lengthy training periods, but particularly high reliability. Simply confusing two roving yarn bobbins in a night shift is sufficient to ruin, in the worst case, the whole production of several days. And under certain circumstances this will often only be recognized during the dyeing of the finished woven fabric. Particularly older plants require particularly attentive and reliable staff.

A very important component in the control of processes is the start-up, conversion and the shutdown of a production line. This is a particularly attractive object for automation: the shutdown of the plant over the weekend, which is common all over western Europe, not only causes expensive idle periods, but also causes considerable turbulations to the process. Every standstill of a machine constitutes a disturbance and, within a short period, causes machines in front of or behind said machine to fall out of the production cycle. The start-up of a spinning plant is always risky from the viewpoint of production technology. The priority in automation is therefore not the automatic start-up of the plant, but the avoidance of standstills. The use of shifts with low staff requirements during the night or at weekends will in future help to prevent start-ups to a wide extent.

Controlled spinning technology and automation depend on one another. Automation can only cope with good-natured processes. Unexpected sudden deviations of sliver properties cause disturbances to the production process as will technically caused standstills of individual machines. Even if the mean passage time of a material element from the fiber bale to the yarn takes several days, certain process stages require interventional cycles in the minute range to maintain the flow of material. The organization and the operation of a spinning plant is tightly linked to the production cycle of individual machines.

The areas of blowing room, carding room, preparation and final spinning and winding were originally own departments, which were separated by the material buffer from a process technological viewpoint. The prerequisites for such a separation no longer exist. Despite the highly increased production rate, the operation of a whole processing stage or several connected machines is nowadays often carried out by a single person. The processing cycle is thus even more sensitive to malfunctions, and the manpower reserve for unplanned interventions is more or less nonexistent.

This leads to the supervision of the machines as the first field of application for computer networking. The statistics of runtimes and standstills provides the user with conclusions which lead to a more efficient employment of manpower. The supervision of the quality of drawing-frame sliver and yarn allows the user to diagnose spinning-technological malfunctions in the process cycle. It facilitates the maintenance of the machines in time.

Both problems have been solved from a technical viewpoint to the extent as is allowed by the individual production machines with their specific operational patterns. This supervision, however, soon reaches its narrow limits by a lack of information caused by the manual handling of the transports and further important interventions:

- Only the standstills, but not their reasons are automatically recorded. To draw up malfunction statistics the operator's cooperation is still required.
- The material flow is not controlled. The propagation of an error can only be traced by guessing.
- Technologically important interventions such as the elimination of yarn breakages or the removal of laps are only registered indirectly, e.g., through the standstill periods of the spinning position or the machine.
- Finally, the statistics only show the past. They are susceptible to numerous wrong conclusions. A rapid intervention (still the prerequisite for a timely removal of a malfunction) still requires an inspection round by an attentive operator.

Further steps in process supervision are therefore dependent on the automation of the most important operating functions. To assess various data processing concepts it is therefore important to view these within the context of other automation functions.

The economical pressure to introduce automation exists primarily at places with the highest manpower requirements. Primarily these are start spinning as well as the transport and the exchange of the roving yarn bobbins. In rotor spinning, where the automatic start spinning already belongs to the state of the art, the transport of the spinning cans in the preparatory drawing frame and the discharge of the yarn bobbins are future focussing points.

The functions mentioned herein form the basis for data processing networking, which will be complemented by the already existing quality monitoring system in the card, drawing frame (for example according to out PCT application with the international publication number WO 92/00409) and the bobbin winding machine. At present various parts of this automation are in the development stage and are not yet widely used. But precisely this should be taken into account in the various concepts for data processing networking. Valuable chances for the future would be forfeited if insufficient transmission capacities were provided.

Despite the use of operating robots and conveying systems, one can expect that a whole number of operating processes, mainly pertaining to exceptional situations and maintenance, will be reserved to the human operator. The operating capacity that is stretched to the utmost limits has to be used according to precisely defined priorities. This is an important and time-critical task in the area of operator support. Practical experience gained in pioneering enterprises which have already realized individual automation steps confirm the decisive role of the alarm system. The right man at the right place becomes the criterion for the operation of the whole plant. This cannot be ensured by communication from person to person, because even the search for a worker in the plant requires an extended round lasting several minutes.

Similar time-critical sequences come about by concatenation in the material flow. The traditional separation of the individual processing stages by large intermediate stores does not meet the requirements of a flexible, qualitatively rigidly monitored production line. Transport automation thus means for data processing that there is the step of supervising the control of certain interfacing positions and thus the direct inclusion into the process. Any breakdown of the control function is directly equivalent to a malfunction in the production. The reliability of data processing is of similar importance to the plant as the reservation system is to an airline company: any breakdown will lead to severe consequences within minutes. The manufacturers of spinning plants see data processing and regard it as being more than simply a PC application or a supplement to the data processing system within the plant.

FIG. 3 combines the functions and the requirements to the time-related capabilities of process control in the spinning mill.

CONCEPTUAL ASPECTS OF THE INVENTION

In principal one can distinguish between two former starting points for the concept of a networked process computer solution:

- The expansion of production planning and control into the production line right up to the individual process stage and machine, which is identical to a top-down introduction of data processing.
- The arrangement of quality monitoring by including material flow monitoring right up to full process monitoring. This procedure is equivalent to a further development of the known systems for acquisition of operational data and quality verification.

The present invention is based on a third concept, i.e., the introduction of new spinning machines with controllable properties for the operation with closed control loops. This also includes the elimination of malfunctions by operating robots (usual case) and operating staff (exceptional case, maintenance). This concept means the conversion to the actual process control. It requires a high degree of automation and process monitoring. FIG. 4 provides a respective overview of the introduction of process data processing in spinning.

The concept per se is not new—approaches in this direction can be found in the state of the art mentioned in this application. However, the concept has not yet been thoroughly implemented in spinning.

The step towards process control requires powerful communication that is able to cope with future demands. The presently available standardized interface is sufficient for acquiring operational data. It is, however, not sufficient for controlling the processes of linked machines. The limits for possible applications are not only the transmission capacities:

- Process control requires the highest possible operational safety. However, the operator guidance (alarms) which is linked to the process control requires high speed and high data throughput. Both functions of the network have a direct influence on the operation of the process. As regular inspection rounds by the operator are no longer required, a highly automated modern spinning plant will fully depend on a well-developed alarm system.
- A comprehensive compaction and evaluation of sensor signals, possibly in form of a spectrogram, can no longer be carried out in all machine controls due to the required processing capacity. A powerful quality monitoring system thus must have access to the raw data obtainable directly from the sensor. A prior compaction by a local evaluation unit makes a future expansion of the functions extremely expensive and difficult. The transmission of raw data is not time-critical and can be subjected to certain compromises pertaining to the reliability. It requires, however, high data throughput.
- Practical experience with commercially available interfaces has shown that one can expect only one-tenth of the theoretically available transmission capacity for the application. The remainder is used for self-checks, the control of the data traffic and as reserve for peak periods.

FIG. 5 outlines the requirements to the data transmission capabilities of a network that is designed for carrying out the functions as shown in FIG. 3.

This leads to a data processing concept that can combine all machines, operating positions and sensors that are important for the process also in the "main problem field" (i.e., in the end spinning stage up to the individual slub catchers). It will, however, be necessary to subdivide the network so as to cope with the numerous connecting positions. Preferably, free access of the process control computer to all interfaces in the plant, including the alarm of the operating staff, is to be provided. According to this concept it is possible to build up the communication step by step and to renew it with clearly defined means. The common element is the powerful process control computer which has to be provided with the required interface drivers. The individual machine control units must be provided with networkable interfaces for bidirectional data transmission and at least be in the position to report the prevailing operational conditions.

The choice of the individual interface protocols is of minor importance than is usually assumed. Serial data transmission in these systems is taken for granted. The transmission standards RS-232, RS-422 and RS-485, which work with 2-wire lines, will probably no longer be sufficient for the second half of the nineties: The capacity and the range are already now very narrow for plants with a dozen connecting points and line lengths of up to several hundred meters. By subdividing the network into several smaller network it is nevertheless possible to obtain suitable solution with the advantage of low-cost cabling. Networking with coaxial cables, which is common in commercial data processing, is an investment which will retain its value in future. The MAP design initiated by the American industry is based on this technology, similar to IRELAN as chosen by Rieter. A future implementation of optical waveguides will provide at least the same transmission capacities.

When network standards are developed, telecommunications hardly take the needs of the textile industry into account. Therefore, only products that are widely used in industry can be chosen. They must ensure the required lifetime and reliability. The required hardware components and software drivers are precisely specified and do not need any specific development.

THE INVENTION

In accordance with the concept mentioned above, the invention provides a spinning plant with a process control computer for at least one group of machines, whereby each machine of the group is provided with an own control unit which controls the actuator components of the machine (plus any auxiliary aggregates allocated to said machine). At least one network is provided for bidirectional communication between the computer and each machine of the group.

Control instructions from the process control computer are transmitted by the network to the machine control units during the operation of the plant. Each machine control unit forwards the control instructions to the control units of the actuators which are controlled by said control instructions, whereby the control instructions, if required, are converted by the machine control units into control signals which are suitable for the actuators.

The transmission of the control instructions can take place directly from the process control computer to the machine control units. The transmission, however, can also be carried out through a further device such as, for example, a "machine station" of the type as described in EP 0 365 901. It is important, however, that neither the process control computer nor a transmitting device (such as the said machine stations) are granted direct access to the actuators of the machine. Instead, if an intervention in the actuators is required because of a change in the condition of the machine, it may only be carried out by the machine control unit (and in accordance with the operating program that is effective in said control unit).

The connection of the machine control unit with its (controlled) actuators can be arranged independent of the communication network between the machine control unit and the process control computer. It may also be different for various actuator elements (or auxiliary aggregates). Concerning a machine with a plurality of processing positions (such as, for example, a so-called longitudinal pitch machine) and with an autonomous control unit for each processing position, the connection between the machine control unit and the existing actuators can be realized by autonomous processing position control units, for example according to DOS 3928831 or DOS 3910181 or DPS 3438962.

In a ring spinning machine it is quite improbable nowadays that the communication link between the machine control unit and the processing position control units could also be used for signal transmission between the machine control unit and an auxiliary aggregate (such as, for example, a doffing apparatus of a ring spinning machine) which is jointly used by all processing positions. In the new spinning process it is foreseeable, however, that the auxiliary aggregate is arranged as a moveable automatic device and provided for the communication with a main frame via the processing positions, as is shown in EP 0295406.

Depending on the arrangement of the actuator elements, the signal connection with the machine control unit can be based on electrical, optical, magnetic, pneumatic, mechanic (or other) signal transmission means.

In any case, each machine control unit is able to translate (convert) the control instructions received from the process control computer into suitable signals for its own actuator elements. The process control computer can thus work with a single set of control instructions for a given type of machines, irrespective of whether the machines of this type which are connected with the process control computer are equipped with the same or different actuator elements or auxiliary aggregates.

The sensors of the machine preferably comprise at least one safety sensor which is connected for signal transmission wit the machine control unit. By means of the sensors the machine control unit is preferably in the position to produce a true image of the condition of the machine (in particularly the safety condition). The machine control unit may be programmed in such a way that it only carries out a control instruction from the process control computer if according to the image of the condition of the machine it can be transferred to the new condition without endangering persons, machines or operating installations. The "safety condition" of the machine thus comprises both the safety of the human operators as well as that of any existing moveable operating devices (in particular automatic operating devices) and elements integrated in the machine. This is particularly important in connection with humans who can move freely in the area of the machine, but also in connection with any moveable devices which are not continuously, but only temporarily near the machine, such as conveying devices for feed material, for example.

In the preferred embodiment the invention is realized in a plant in accordance with our PCT patent application with the international publication number Wo 91/16481, i.e., in a plant in which at least one machine control unit comprises a user interface and in which the process control computer can use said user interface for communication with a human or with a moveable automatic device at this machine. This arrangement can ensure relatively easily that specific signal is provided with a specific meaning within the whole plant controlled by the computer. This system may be put in contrast to a system in which the operator support is provided by a system which is independent of the machine control units, for example according to U.S. Pat. No. 4,194,349 The advantages of the combination according to this invention are particularly visible if a process control computer influences both the operator support as well as the control of the machines, for example in a doffing management system for ring spinning machines, similar to a system as set forth in U.S. Pat. No. 4,665,686.

The operator support via the user interface naturally also ensures that help is offered whereever it is required. This also enables a simplification of the alarm or calling system, because the operator principally only has to be called to the affected machine without having to be informed about the required action to be taken. The alarm or calling system must naturally also ensure that the operator is informed about the urgency or priority of the operator call and that the correct operator or worker (doffing help, maintenance, elimination of yarn breakage) is called to the affected machine.

Through the user interface it is possible to give the operator the instruction to carry out an action which cannot be carried out by the machine control unit itself, because, for example, the required actuators are not present in the machine or are not under the control of the machine control unit. One example for such an action (i.e., the stopping of a badly functioning spinning position where the machine control unit cannot intervene directly at the spinning position) is described in our CH Patent Application No. 697/91-2 of Mar. 7, 1991 (Obj. 2211). The operator may, however, also be required to enter certain information (data) into the communication system (through a keyboard, for example). These data complement the image of the system in the process control computer if the required sensor are not provided in the controlled machines.

The operator is preferably in the position (or even "forced" to do so) to cause the generation of a signal which represents the execution of an instruction and to provide this information to the machine control unit or the process control computer.

The preferred plant in accordance with the invention is provided with a sensor system which guarantees the operation of the plant without the process control signals of the process control computer. In accordance with this preferred arrangement, the plant is provided as a "conventionally' operated plant, i.e., at the machine level it is provided with such a sensor system and with such machine control units which are connected to said sensor system that the plant is fully operable even without the process control computer. The control signals generated by the operational process control computer act in an optimizing manner on the plant that is operable even without the process control computer, whereby the machine control units of the plant are able, due to the signals provided by the sensor system to which they are connected, to check the plausibility of the control signals at any time. A machine control unit will only carry out a control instruction from the process control computer if the plausibility check does not show a contradiction between the control signal (control instruction) of the process control computer and the condition of the plant as determined by the sensor system. Otherwise the machine control unit will issue an alarm signal. The "control instructions" from the process control computer are usually provided in the form of scheduled values or are intended to initiate processes or changes in conditions in the machine(s).

The plant ("chain of machines") is operable in the "conventional" manner in the sense that presently known control and sensor systems are sufficient to operate the plant without the process control computer. These presently known control system could naturally be improved. However, they still can be regarded as "conventional" as long as they are able to maintain the operability of the plant without the process control computer certain functions might or must be assumed by the operator. In this case it is necessary to provide the option of human intervention in the "conventional" plant control system. But it is also desirable for other reasons to provide the option of individual interventions by the operator in plant processes, even if the plant is fully controlled by the process control computer.

In accordance with a further aspect the invention provides a spinning plant with the following features:

a process control computer for at least one group of machines of the plant;

an automatic control unit for each machine of said group;

a network for bidirectional communication between the process control computer and the autonomous control units, whereby control instructions can be transmitted from the process control computer to the control units via the network;

operating means for at least one control unit, so that said control unit can be reset by said operating means, whereby the operating means comprises a selectively actuatable means by which said control unit can be brought to a first or second condition, so that in its first condition the control unit only reacts to the operating means and in its second condition the control unit reacts both to the operating means as well as to control signals coming from the process control computer.

In a plant where all machine control units or at least the critical machine control units are arranged in accordance with the second aspect of the invention it is possible that the operator may at any time (through the "operating means") intervene in the process cycles of the plant, irrespective of whether the process computer is operable or not. Furthermore, said operator may disconnect any individual machine, or at least certain machines, from the process control computer and then, for example, carry out trial runs, maintenance works or alterations in the selected machine.

In the event of a breakdown of the process control computer (or one of its important functions) or the communication network between the master computer and the machines, the machine (or each machine) or the sensor system is preferably connected with local storage means for preliminary saving of any acquired data for the purpose of supplying said data to the process control computer. As soon as the computer or the network are on-line again, the data saved in this manner can be supplied to the master computer. Each "communication unit" (apparatus which supplies data via the network to the master computer) may, for example, be provided with means to verify whether or not the supplied data were accepted (or "acknowledged", for example). If, for example, the "acknowledgment" (confirmation about the arrival of the supplied data to the process control computer) is missing, the connection of the respective sensor system with the preliminary storage means may be realized. It is also possible that during normal operation the acquired raw data are written into a local buffer memory and that the data is only supplied to the network if it is "ensured" that the communication with the process control computer will take place as planned.

In accordance with a third aspect of the invention, "raw data" are supplied to the process control computer. "Raw data" shall not (necessarily) mean the actual output signals of the sensors, but at the least the complete "informational contents" of such signals.

In accordance with a fourth aspect of the invention, the controlled plant is fully operable despite the availability of a process control computer, whereby the machines are provided with the required sensors for this purpose.

These and further aspects of the invention are now outlined in greater detail by reference to the examples as outlined in the drawings, wherein:

FIG. 1. schematically shows the distribution of the creation of value in a ring spinning machine for combed cotton;

FIG. 2. schematically shows the manpower requirements in the processing stages;

FIG. 3. schematically shows the functions of process control in spinning (showing the type of data and the occurrence of the signals by time);

FIG. 4. schematically shows the introduction of process data processing in spinning;

FIG. 5. schematically shows the data transmission requirements;

FIG. 6. shows a layout diagram in a spinning mill up to the spinning (without rewinding);

FIG. 7. shows a summary of the diagram of FIG. 6;

FIG. 8. shows a computer arrangement for a process control unit in a plant in accordance with FIG. 7;

FIG. 9. schematically shows the networking of machines, operating robots and conveying systems;

FIG. 10. shows a diagrammatical representation of the connection between a machine control unit and a spinning position;

FIG. 11. shows a diagrammatical representation of the connection between a machine control unit and a spinning position;

FIG. 12. schematically shows a possible architecture of a process control unit;

FIG. 13. shows a modification of the architecture according to FIG. 12;

FIG. 14. shows a further modification of the architecture according to FIG. 12;

FIG. 15. shows a list of all terms, standards and conditions that are important for the process control;

Figure 14:
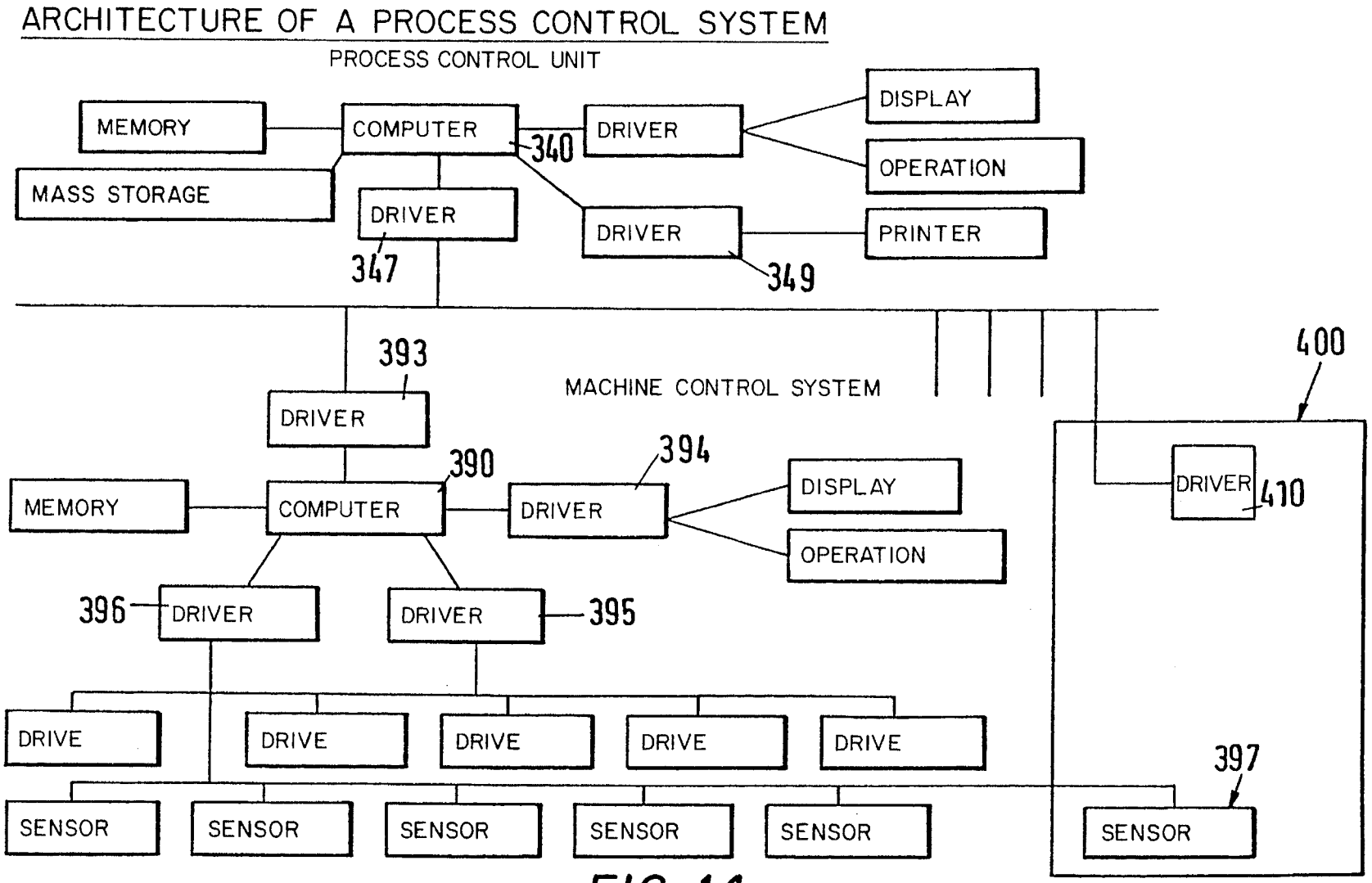
Figure 18:
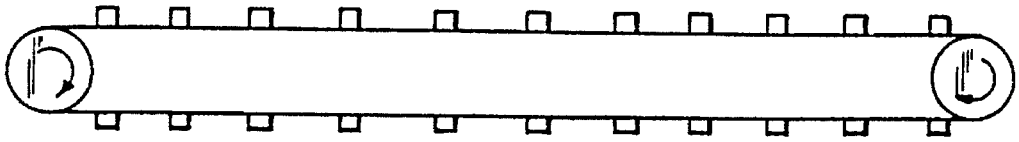
Figure 19:
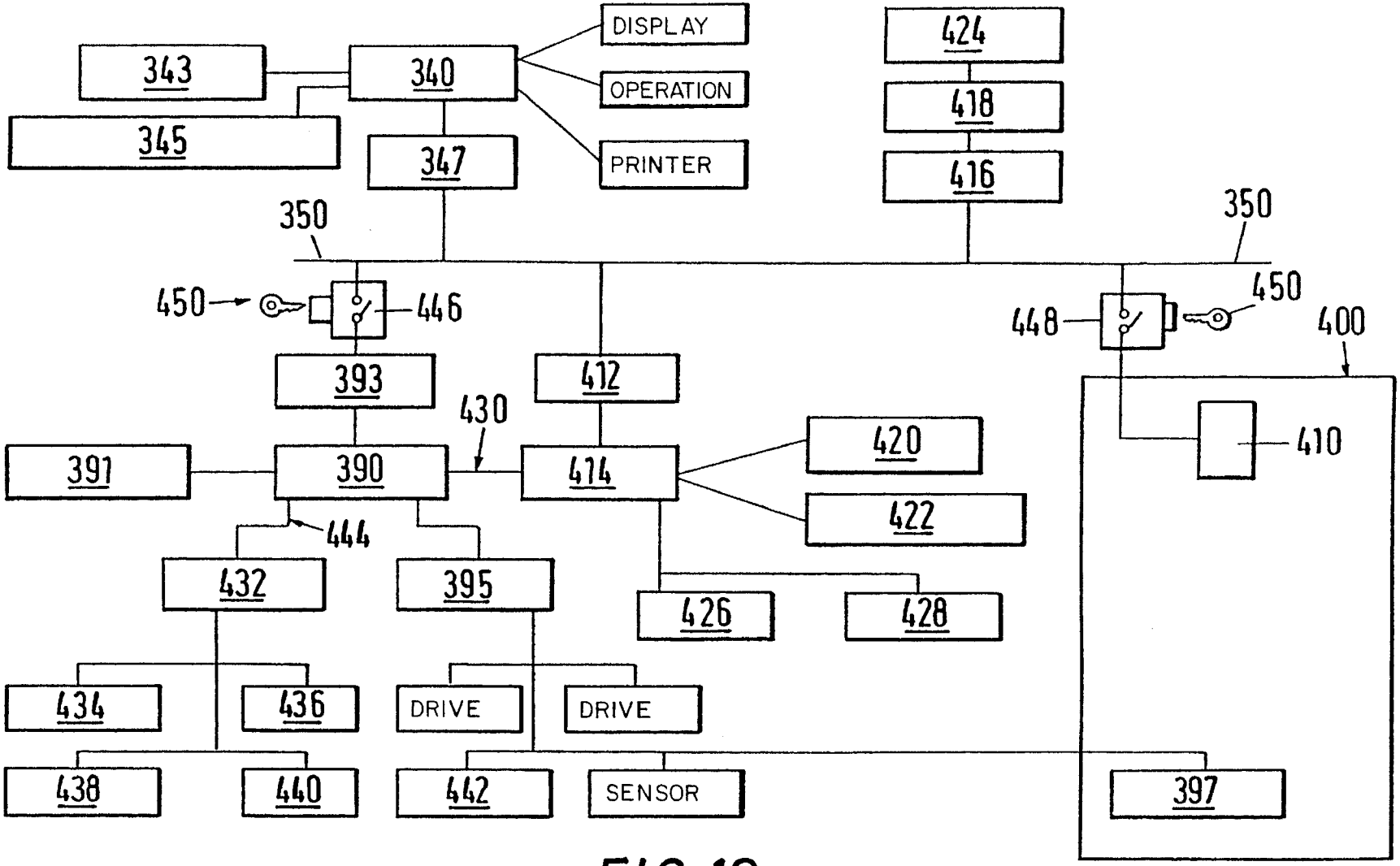
Figure 21:
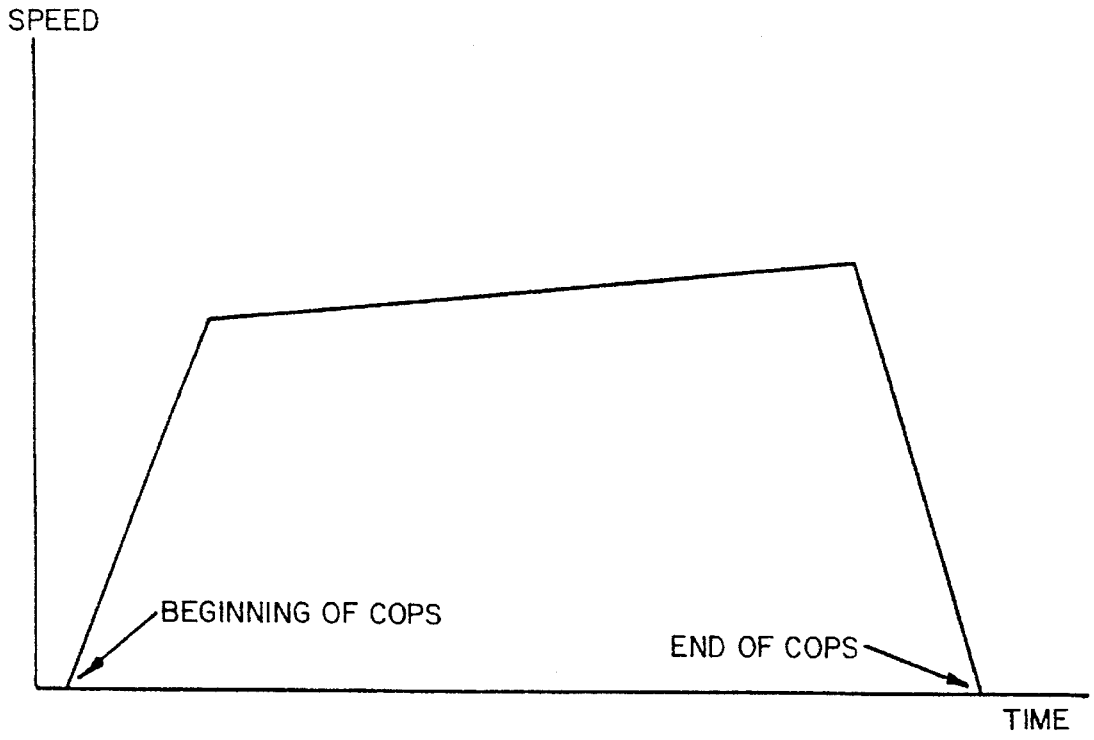
Figure 22:
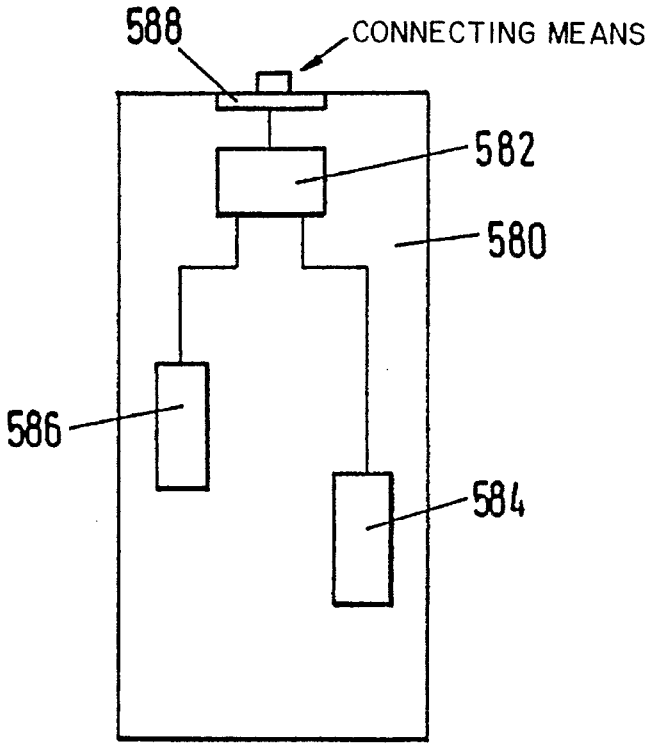

FIG. 18 provides a schematic representation of a conveying device built into a machine;

FIG. 19 shows a modification of the arrangement in accordance with FIG. 14;

FIGS. 20A–20D show diagrams for explaining various possibilities of the invention;

FIG. 21 (schematically) shows the so-called twist factor curve of the ring spinning machine, and FIG. 22 shows a diagram for better explanation of the machine with "communication abilities".

The problems concerning process control (whether automatic or by human operation) in spinning are partly due to the "splitting" of the material flow between the input into the processing line and the discharge to the yarn storage or to further processing in weaving or knitting. This will be outlined below in greater detail before the application of the principles of the present invention will be explained. The plant mentioned hereinunder is conventional and has already been shown in the PCT Application No. PCT/CH/91/00140 (international publication number WO 92/00409); it shall only serve as an example.

Figure 1:
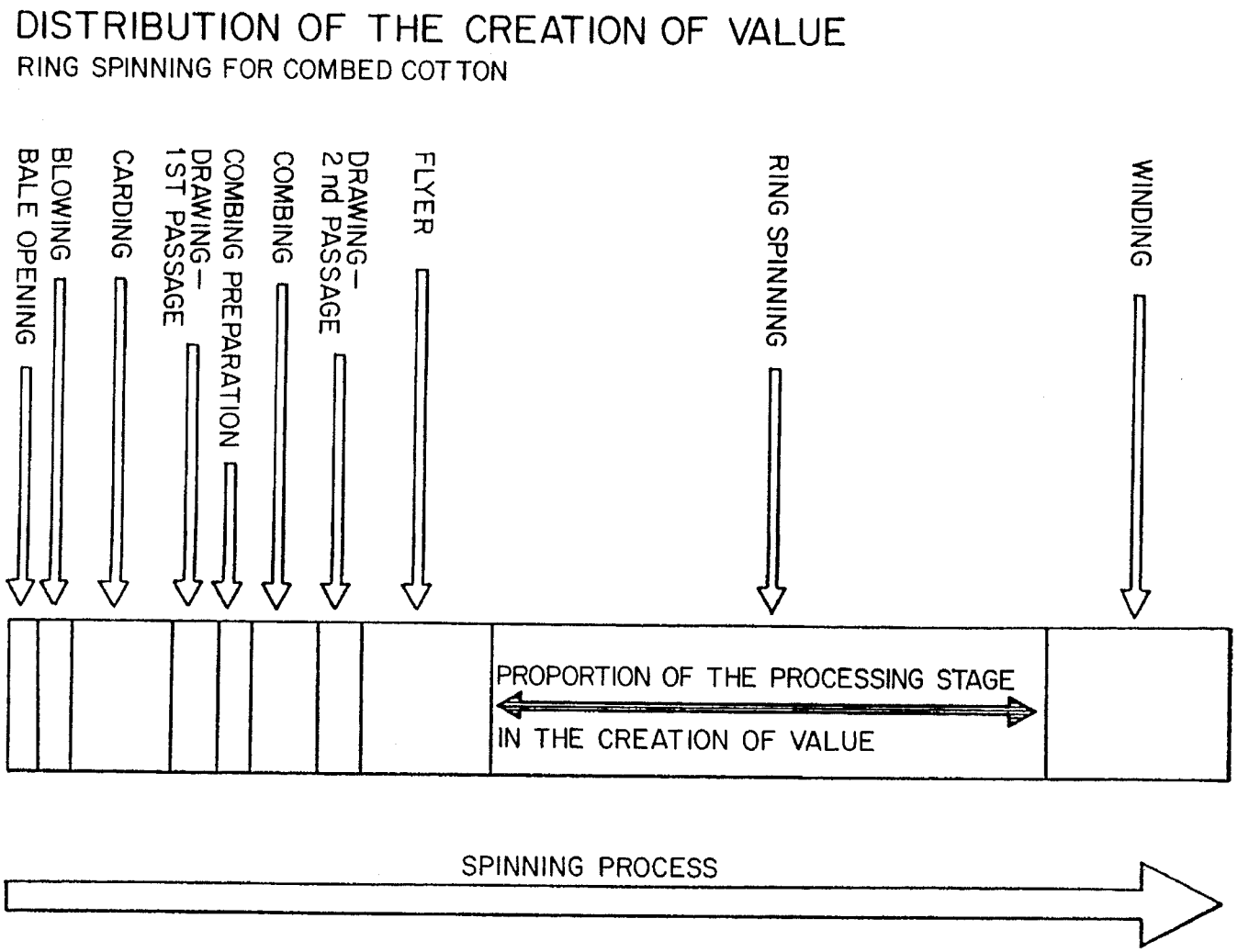
Figure 2:
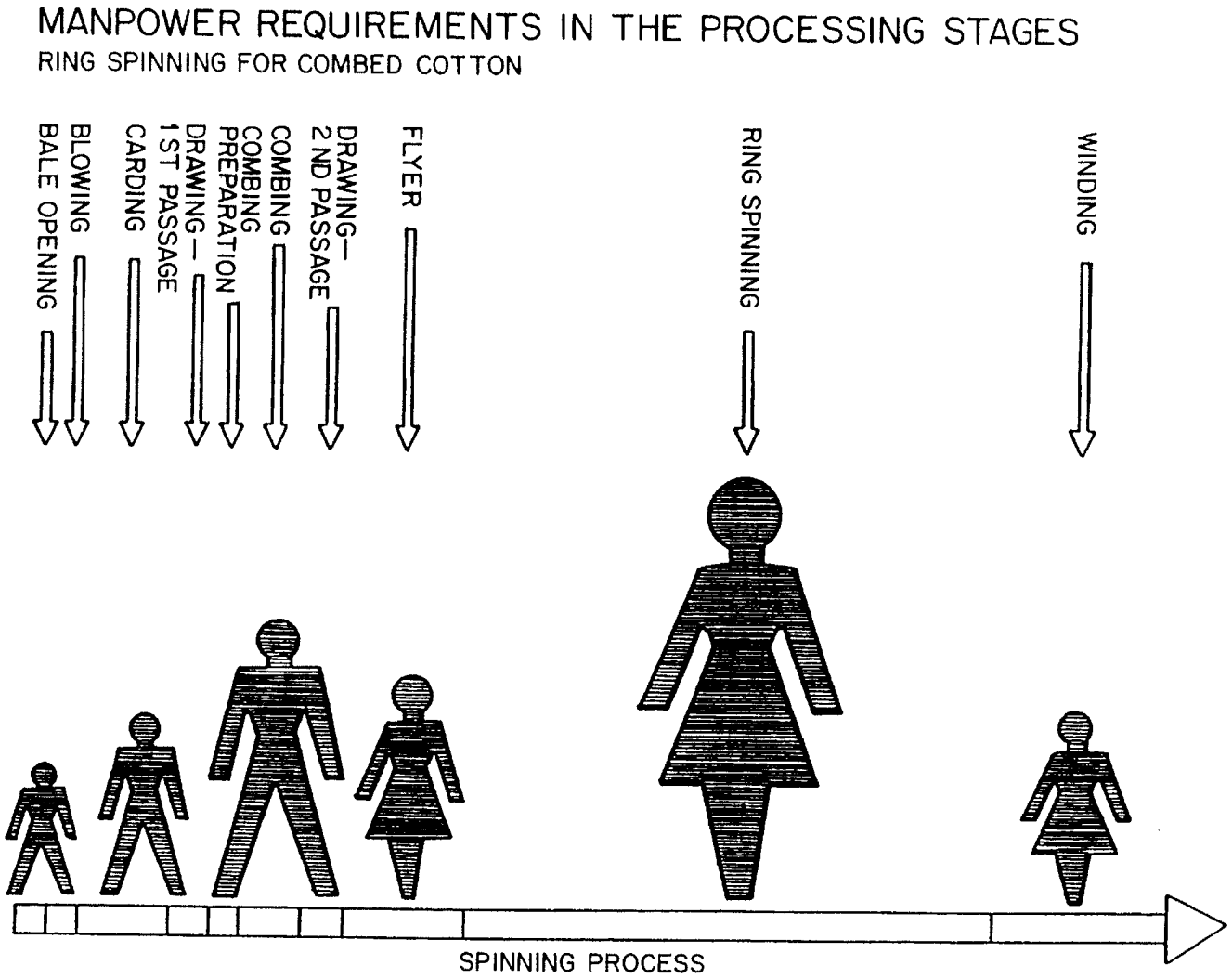
Figure 3:
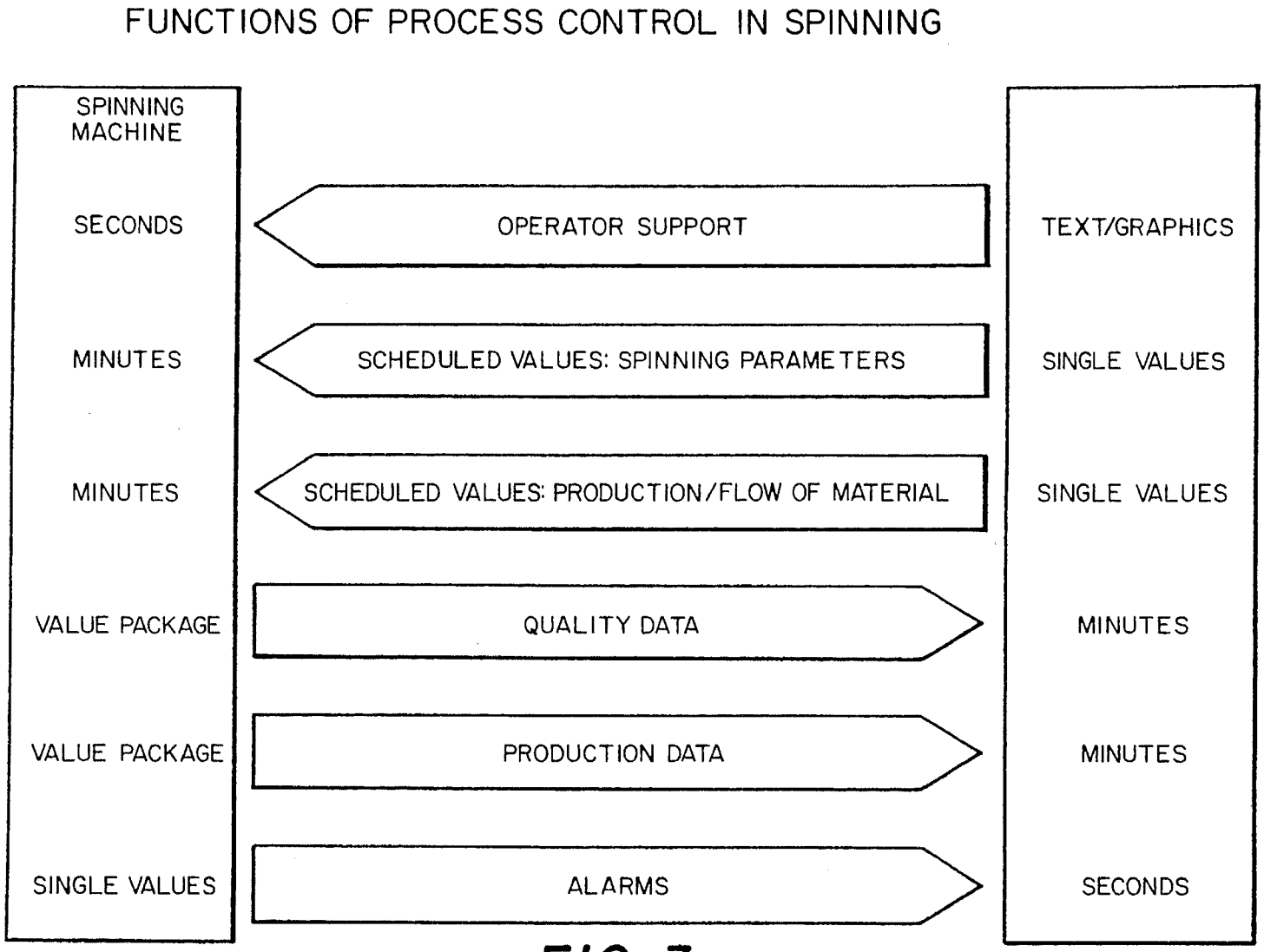
Figure 4:
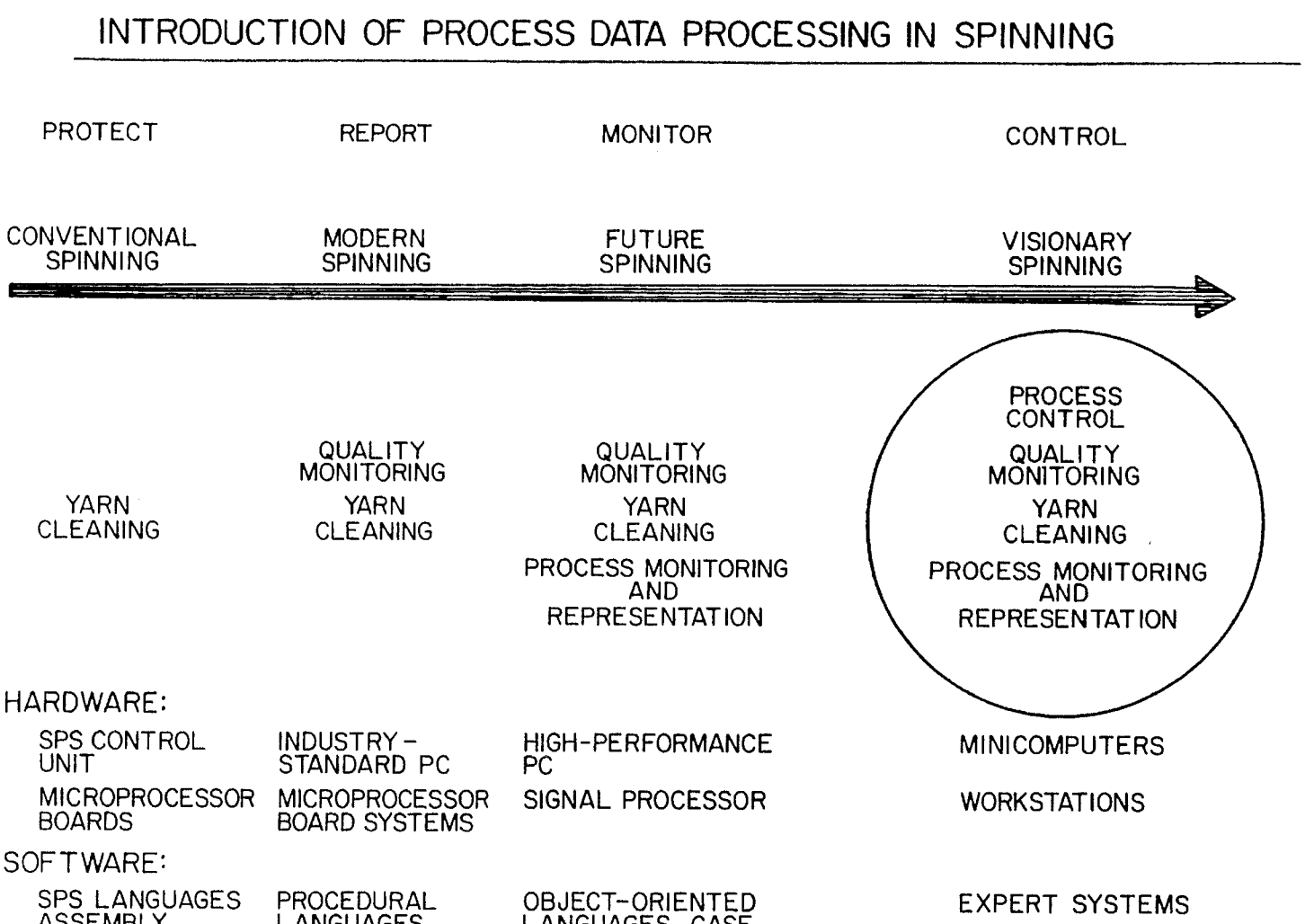
Figure 5:
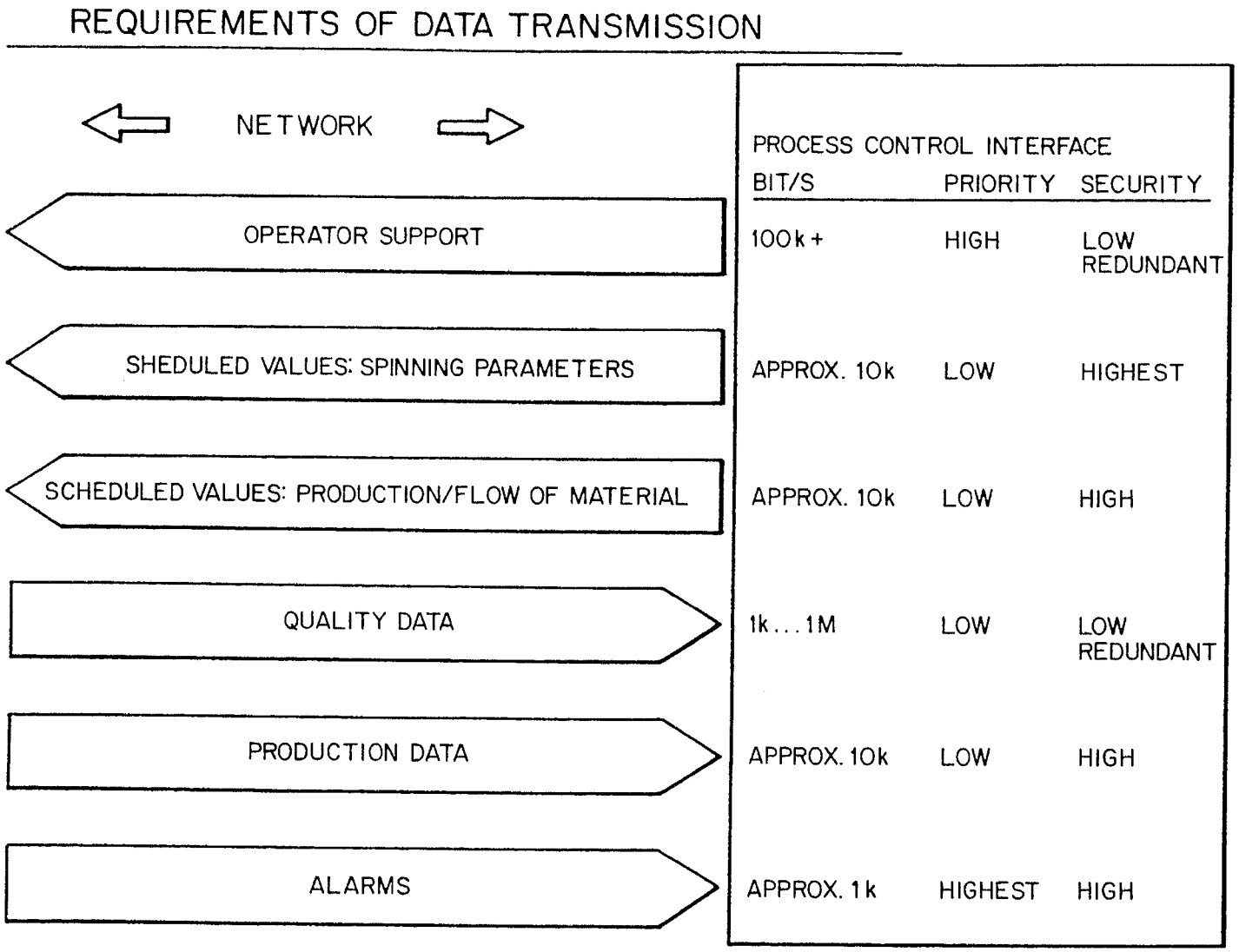
Figure 6:
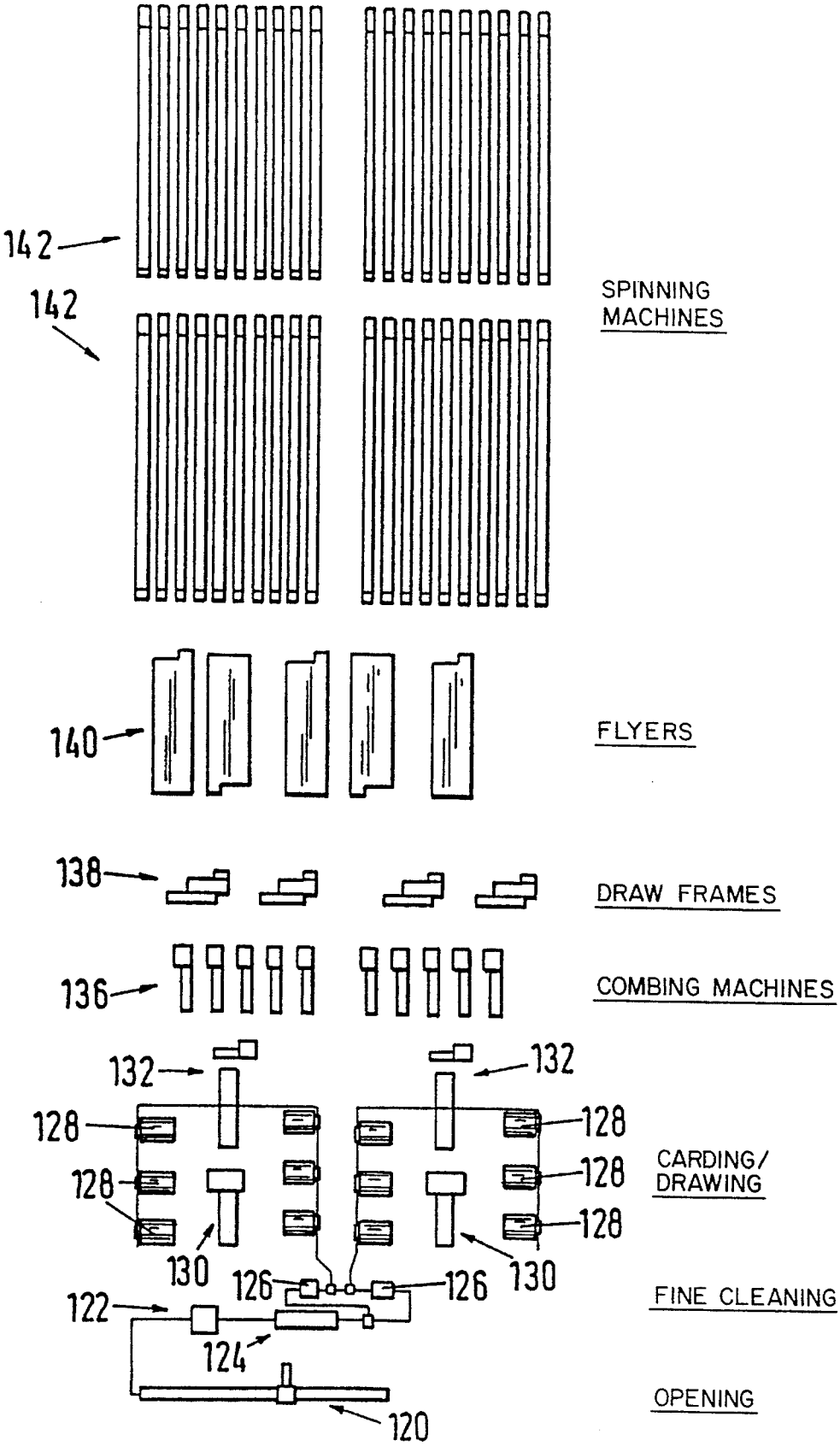

The spinning mill represented in FIG. 6 comprises a bale opener 120, a coarse cleaning machine 122, a mixing machine 124, two fine cleaning machines 126, twelve carding machines 128, two drawing frames 130 (first drawing passage), two combing preparation machines 132, ten combing machines 136, four drawing frames 138 (second drawing passage), five flyers 140 and forty ring spinning machines 142. Each ring spinning machine 142 comprises a large number of spinning positions (up to approx. 1200 spinning positions per machine). This will be explained below in greater detail by reference to FIG. 16.

FIG. 6 shows a present conventional arrangement for producing so-called combed ring-spun yarn. The ring spinning process may be replaced by a newer spinning process (e.g., rotor spinning), whereby the flyers would then no longer be necessary. As, however, the principles of the present invention are applicable irrespective of the type of the end spinning stage, the explanation in connection with conventional ring spinning is also fully sufficient for the application of the invention in connection with the new spinning methods. FIG. 6 does not show the winding department, which is not used anyway in the new spinning processes (e.g., rotor spinning).

Figure 7:
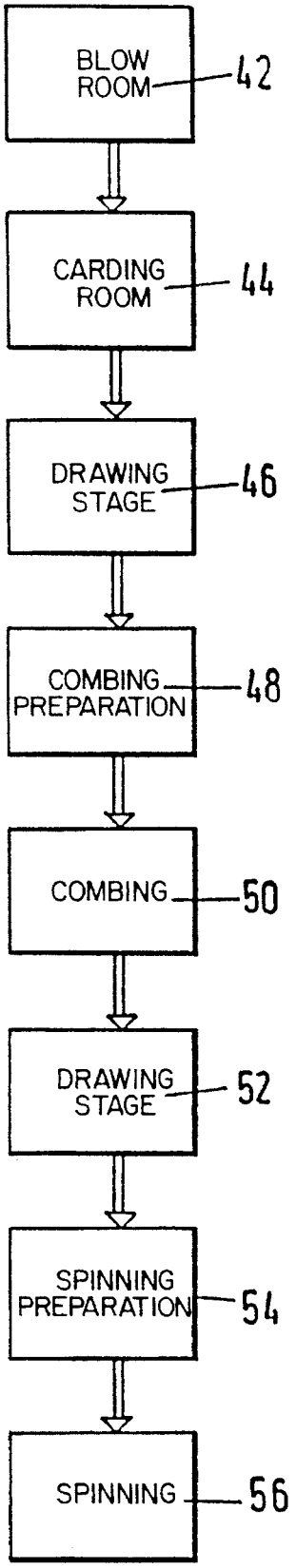

The spinning mill in accordance with FIG. 6 is schematically shown again in FIG. 7, whereby in the latter case the machines have been combined into so-called "processing stages". In accordance with this approach, the bale opener 120 and the coarse cleaning machine 122, the mixing machine 124 and the fine cleaning machine together form the so-called blowing room 42, which supplies the carding room 44 with substantially opened and cleaned fibre material. Within the blowing room, the fibre material is conveyed from machine to machine by means of a pneumatic conveying system (air stream), which system finishes in the carding room. The cards 128 each supply a sliver as intermediate product which is deposited in a suitable container (a so-called "can") and then conveyed further on.

The first drawing passage (through the drawing frames 130) and the second drawing passage (through the drawing frames 136) each form a processing stage 46 or 52 (FIG. 7), respectively. In between, the combing preparation machines 132 form a processing stage 48 (FIG. 7), and the combing machines 134 also form a processing stage 50 (FIG. 7). Finally, the flyers 138 form a spinning preparation stage 54 (FIG. 7) and the ring spinning machines 140 form an end spinning stage 56 (FIG. 7).

Figure 8:
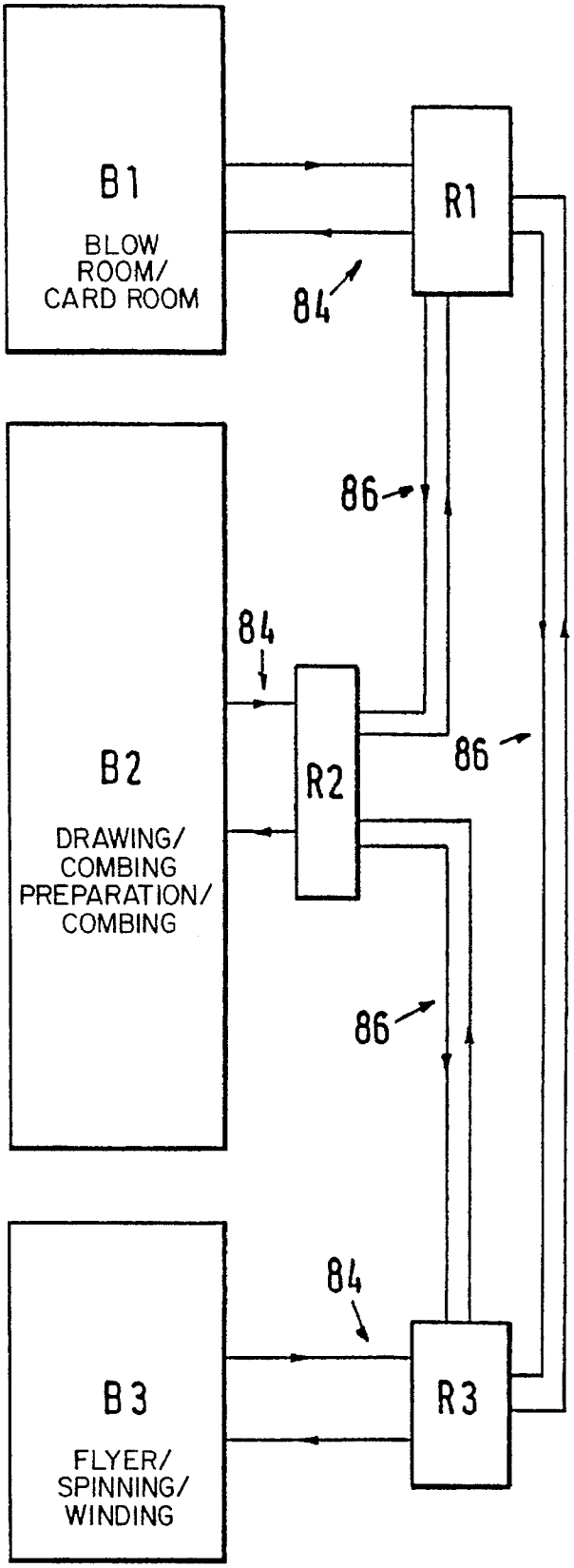

In our German patent application No. 39 24 779 of Jun. 26, 1989 we describe a process control system according to which a spinning mill is arranged in "areas" and signals from one area can be used for controlling previous areas. An example for such a plant is schematically shown in FIG. 8, whereby the plant comprises three areas B1, B2 and B3, and each of said areas is provided with an own process control computer R1, R2, R3. Each computer R1, R2, R3 is connected for the exchange of data (schematically shown in FIG. 8 by connections 86). It will be clear to the man skilled in the art that the representation of FIG. 8 is purely schematical. It is also possible that only a single process control computer is provided which is connected with all areas of the spinning plant and which carries out the desired exchange of signals between said areas. It is also possible that further "areas" are defined, for example according to the article "Integrierte Prozessdatenverarbeitung mit USTER MILLDATA" (Integrated Process Data Processing with USTER MILLDATA) by H. P. Erni (Reutling Spinning Colloquium, Dec. 2 and 3, 1987). The shown arrangement with a process control computer R per area B represents a useful arrangement which will be used for the following explanation.

The area B1 comprises the blowing room 42 and the carding room 44 (FIG. 7).

The area B2 comprises both the two drawing passages 146, 152 (FIG. 7) as well as the combing preparation stage 148 and the combing room 150.

The area B3 comprises the flyer 154 and the end spinning stage 156 (FIG. 7) and, possibly, also a winding department.

The adjustment of the systems of FIGS. 6 to 8 to the principles outlined in connection with FIGS. 1 to 5 will be explained in greater detail by reference to FIGS. 9 to 14.

Figure 9:
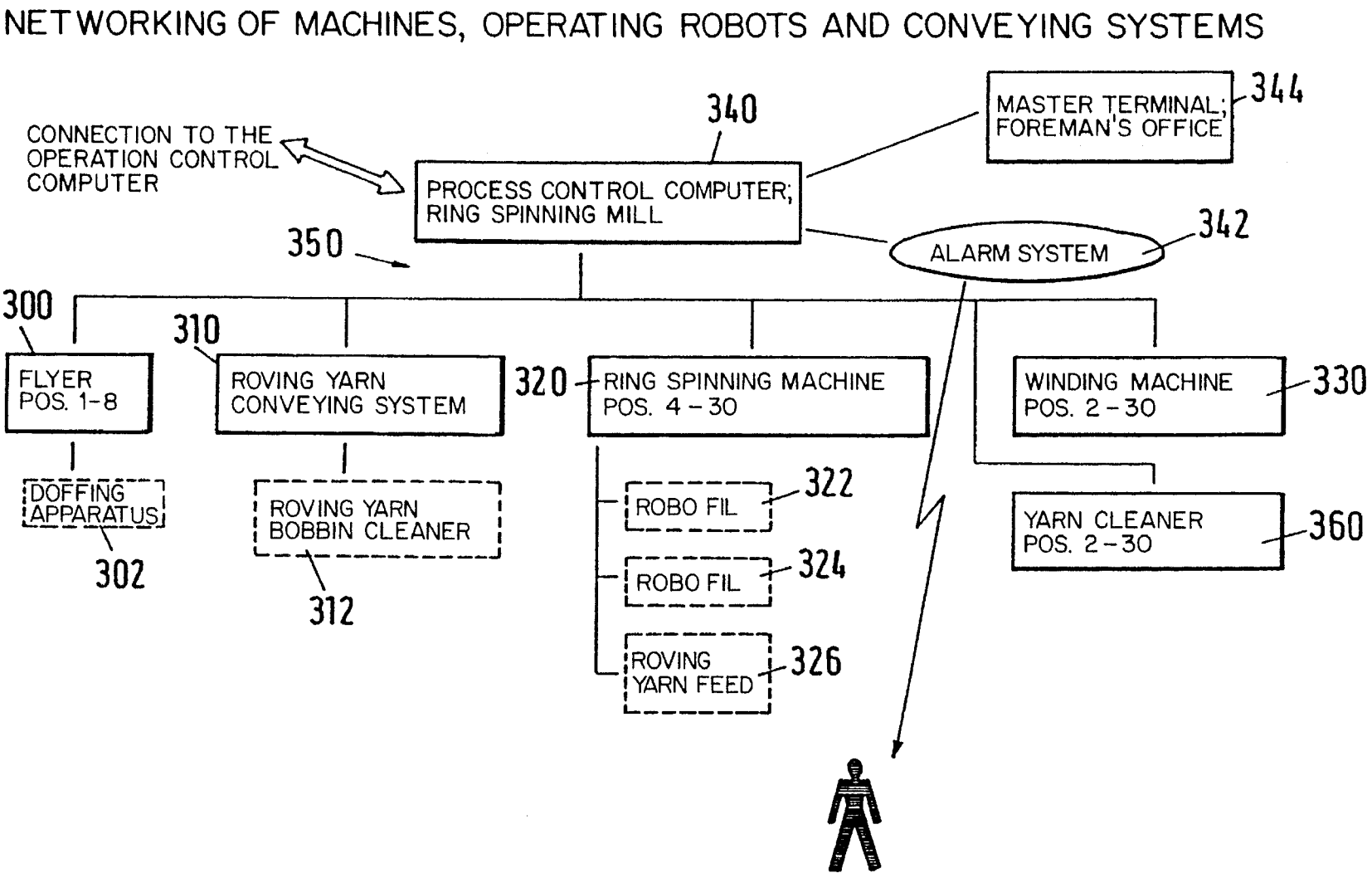

A practical implementation of area B3 in an automated plant is shown in FIG. 9. However, the representation is still schematical so as to outline the data processing aspects of the system. The represented part of the plant comprises as follows (in the sequence of processing stages, i.e., the "concatenation" of the machines):

a) the flyer stage 300 b) an end spinning stage 320; here it is formed by ring spinning machines;

c) a roving yarn conveying system 310 which is used to carry flyer bobbins from the flyer stage 300 to the end spinning stage 320 and to carry empty bobbins from the end spinning stage 320 back to the flyer stage 300, and d) a rewinding stage 330 which is used to convert the cops formed in the ring spinning machines into larger (cylindrical or conical) packages.

Each processing stage 300, 320, 330 comprises a plurality of main processing units (machines) which are each provided with its own control unit. Said control units are not shown in FIG. 9, but they will be explained in greater detail in connection with FIG. 10. Robotics units (automatic operating devices) are linked to the respective machine control units. The robotics units are directly allocated to the respective machine. FIG. 9 shows that each flyer of stage 300 is provided with its own doffing apparatus; the function "flyer doffing" is shown in FIG. 9 in box 302. A possible arrangement is shown, for example, in EP-360 149 or De-OS-3 702 265.

FIG. 9 shows that for each ring spinning machine 320 there is provided one automatic operating device per row of spinning positions and one creeling operating device for the roving yarn supply. The function "spinning position operation" is indicated in boxes 322, 324 (one box for each row of spinning positions) and the function "roving yarn supply" is indicated in box 326. A possible arrangement is shown, for example, in EP-41 99 68 or PCT patent application No. PCT/CH/91/00225 of Nov. 2, 1991.

The roving yarn system 310 is also provided with its own control unit which will not be explained herein in greater detail. The system 310 comprises a unit for cleaning roving yarn bobbins before they are supplied back to the flyer stage 300. FIG. 9 shows the function "roving yarn bobbin cleaning" in box 312. A possible arrangement of this part of the plant is shown in EP-43 12 68 (and partly in EP-39 24 82).

The ring spinning machines of stage 320 and winding machines of stage 330 jointly form the "machine unit", thus ensuring the transport of the cops to the winding machines. The control of this unit is carried out by the winding machines.

A network 350 is provided which ensures that all machines of stages 300, 320, 330 and system 310 are connected with a process control computer 340 for exchanging signals (data transmission). Computer 340 directly operates an alarm system 342 and an operating unit 344 such as a master control unit or a master terminal.

A very important function of the rewinding of ring spinning yarn is the so-called yarn cleaning, which is indicated in box 360. The yarn cleaner is connected with the process control computer 340 via the network 360. This apparatus ensures that yarn defects are eliminated and, simultaneously, information (data) is obtained, which allows drawing conclusions on the previous processing stages. The yarn cleaning function is carried out by the winding machine.

Figure 10:
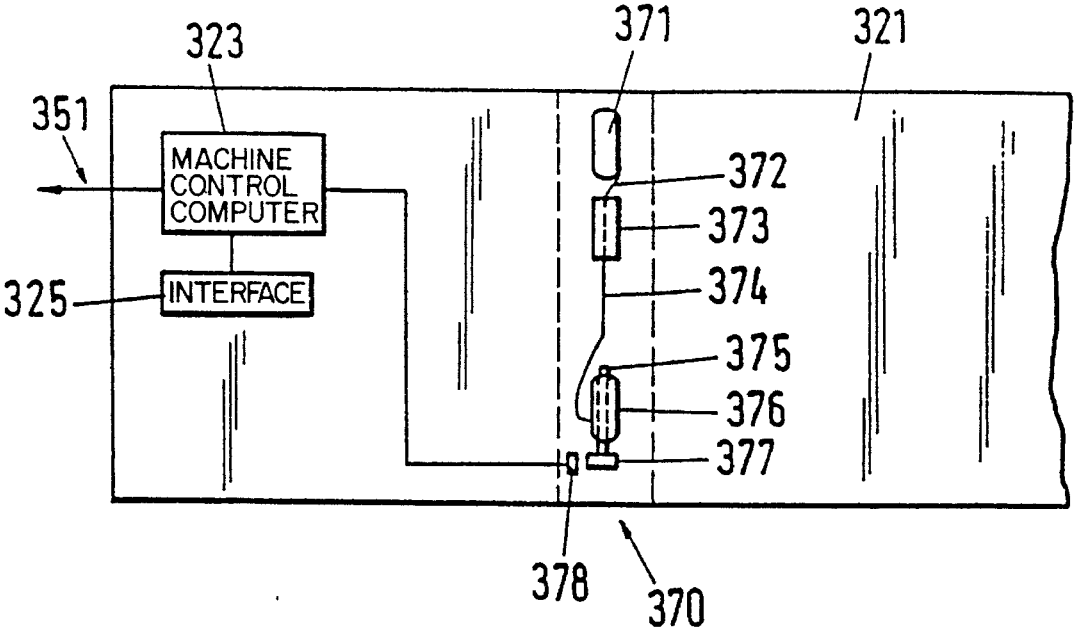
Figure 11:
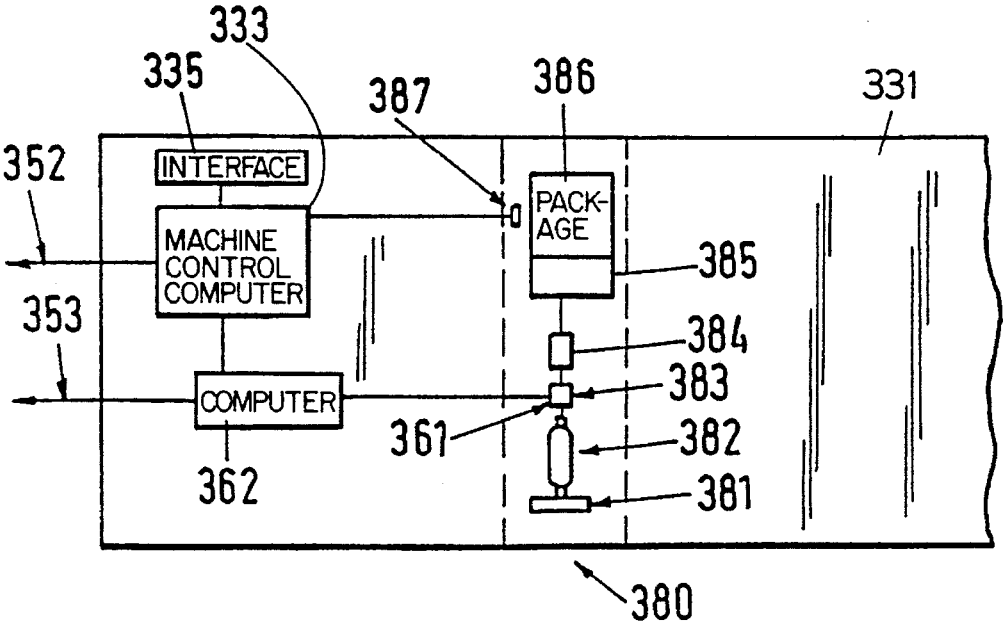

FIGS. 10 and 11 show a somewhat more detailed, but still schematic representation of a ring spinning machine 321 (FIG. 10) of stage 320 and a winding machine 331 (FIG. 11) of stage 330.

The control unit of machine 321 is schematically designated by 323 and the control unit of machine 331 is designated by 333. For each machine 321, 331 the only working position 370 (FIG. 10), 380 (FIG. 11) is indicated schematically. With respect to the ring spinning machine 321, the working position 370 comprises a suspension (not shown) in the creeling (not shown) for a flyer bobbin 371. The fibers emerging from the drawing frame 373 are spun into a yarn 374 which is wound on a bobbin 375 into a cops 376. The bobbin 375 is carried out by a spindle (not shown) which is rotated about its longitudinal axis by a drive motor 377 (single-spindle drive) allocated to said spindle.

The processing position 380 of the winding machine comprises a feed means (not shown) for individual cops carriers 381 (e.g., so-called "peg trays") which each carry a cops 382. The yarn 383 of the cops is wound off and supplied to a jigging unit 385 via a splicer 384. A bobbin holder (not shown) carries a bobbin (not shown) as the core of a package 386 which is formed by the rotation of the bobbin about its own (horizontal) axis due to the axial movement of the yarn produced by the jigging unit.

It is assumed that each processing position 370, 380 is provided with its own sensor units. With respect to the ring spinning machine they consist of a simple sensor 378 for each spinning position so as to ascertain whether spinning positions (of the spindle motors 377) are in operation or not. The winding position 380 may be provided with a respective sensor 387. The winding position 380 is, however, additionally provided with a yarn testing device 361 which forms an element of the yarn cleaner 360 (FIG. 9). The yarn testing device comprises a yarn sensor (not shown separately) which monitors predetermined quality parameters of the yarn and which supplies respective signals (data) to a data acquisition unit 362 of machine 331, which unit collects the data for all spinning positions of this machine. The data unit 362 represents a further element of the yarn cleaner 360. The control units 323, 333 and the data unit 362 are connected with the master control computer 340 (FIG. 9) via the lines 351, 352 and 353 of network 350. The data unit 361 also exchanges signals with the control unit 333 of the winding machine. The automatic operating devices may also be provided with sensors such as is shown, for example, in our U.S. Pat. No. 4,944,033

In accordance with one aspect of the invention the plant is arranged in such a way that the computer 340 has direct access to the "raw data" of the sensor units 378, 387, 361, although the individual control units 323, 333, 362 work independently from said computer (partly autonomous) on the basis of the output signals of the sensor units 378, 387, 361 in the absence of a control instruction from the master computer 340. This means to say that the raw data of the sensor units are not compiled into "reports" by the control units 323, 333 and 362, which reports reduce the information contents of the sensor signals by "concentration," and supply these to the master control computer. Instead, they are supplied to the master control computer (at least on request of the master control computer 340) as quality and condition signals whose contents have not been changed. "Raw data" (in the terms of control units) are principally "actual values" of the sensor units or signals obtained therefrom. In any case they are signals that originate from the sensor units.

Each machine 321, 331 is also provided with a "user interface" 325 or 335 which is connected with the respective control unit 323 or 333 and which allows man-machine (or even robot-machine) communication. The "user interface" could also be designated as "control panel," "control board" or "control console". One example for such a user interface is shown in DE-OS-37 34 277, which concerns a drawing frame and not a ring spinning machine. The principle is the same for all such operating means. Further examples are shown in the article "Neue Mikrocomputer für die Textilindustrie" (New Micro Computers for Textile Industry) by F. Hösel in Melliand Textile Reports of September 1991 (ITMA Edition). The present user interface of G5/2 ring spinning machines of Maschinenfabrik RIETER AG has been shown in "Textile World," April 1991, page 44 ff, whereby further developments of such devices may be expected.

In accordance with the invention of the PCT application No. WO/91/16481 the plant is programmed and designed in such a way that the master control computer 340 can provide operator support via the user interface 325 or 335 of the respective machine, i.e., the master control computer can issue control commands through the network 350, and machine control units can receive and obey such control commands, so that the condition of the user interface is determined by the master control computer via the respective control unit.

Figure 12:
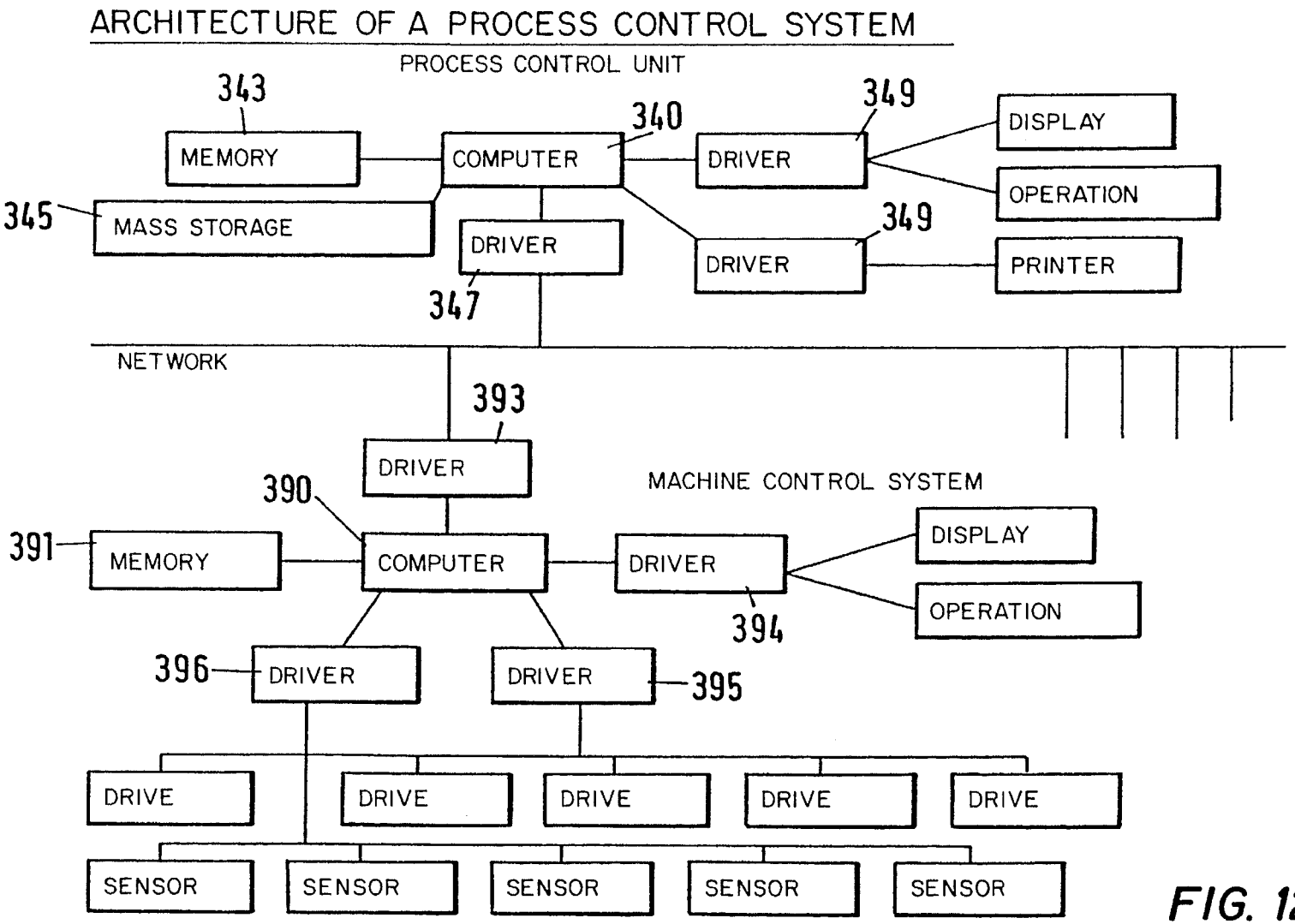

FIG. 12 shows a possible variation of the architecture for a process control according to FIGS. 9 to 11. FIG. 12 again shows the master control computer 340 and the network 350 together with a computer 390 of a machine control unit of the plant (e.g., the roving yarn conveying system 310, which can be equated with a "machine" for the purpose of explaining the processing of data). Each computer 340,390 is provided with allocated memory 343, 345 or 391 and drivers 347, 349 or 393, 394, 395, 396.

The drivers 349 or 394 determine the required interfaces for the communication of the computers 340, 390 which their respective user interfaces, which are designated here as display, operation and printer. Driver 347 determines the interface between the master control computer 340 and the network 350. Driver 393 determines the interface between the network 350 and the machine control unit 390.

Driver 395 determines the interfaces between the machine control unit 390 and the drives thus controlled (e.g., in the case of the ring spinning machine, FIG. 10, the spindle drive motors 377). Driver 396 determines the interface between the machine control unit 390 and the allocated sensor units (e.g., in the case of the ring spinning machines, FIG. 10, the sensors 378).

Figure 13:
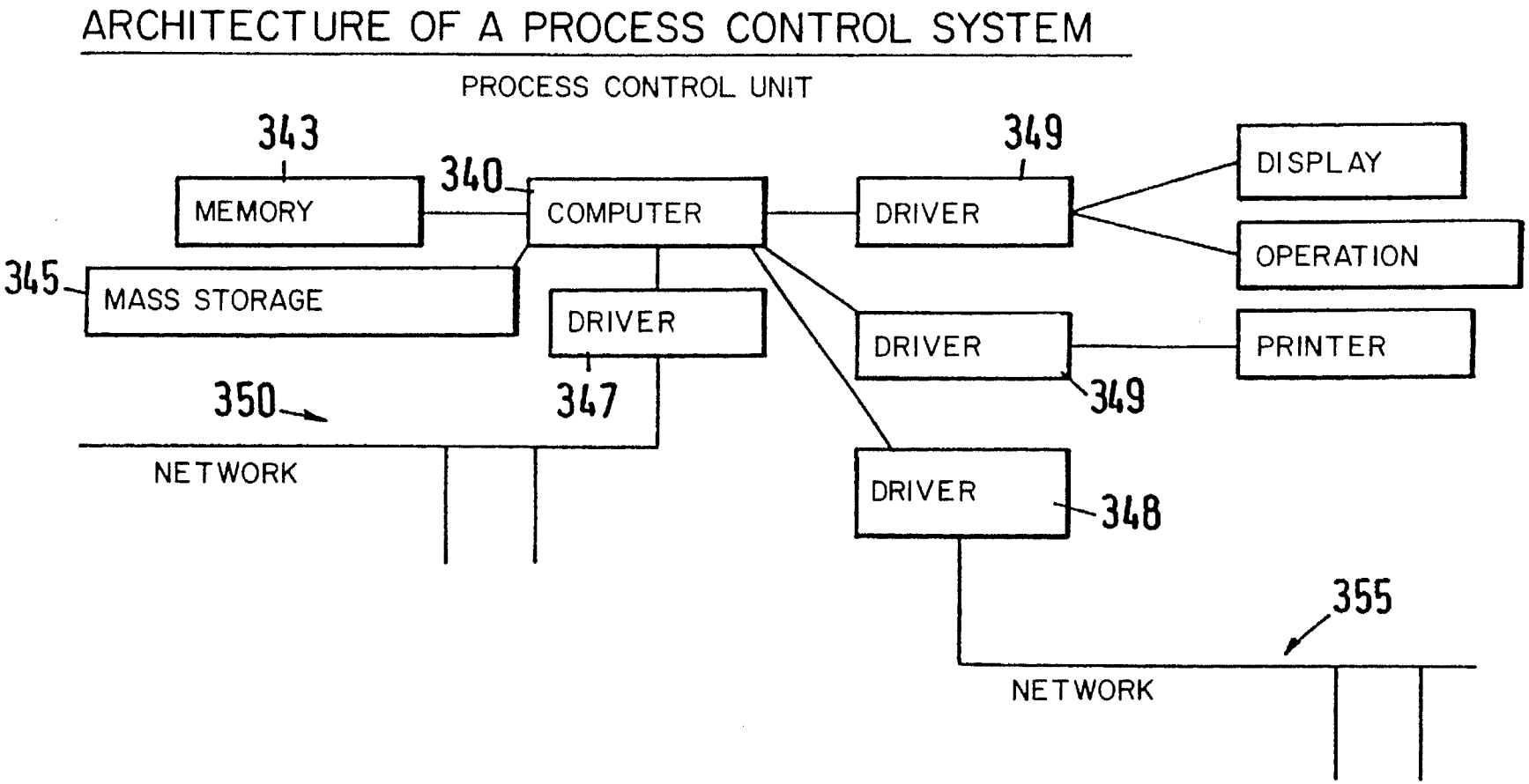

FIG. 13 now shows a first modification of this architecture. The master control computer 340 is now provided with an additional driver 348 which determines the interface between the computer 340 and a further network 355. The machines (not shown) allocated to the computer are now connected either with the network 350 or the network 355. The driver/network combinations 347/350 or 348/355, respectively, are distinguished from one another in that they are compatible with different kinds of machine control units. The machines must be connected with either the one network 350 or the other network 355 depending on the type of control unit.

Only two drivers 347, 348 are shown in FIG. 13. It is, however, quite obvious that further networks, each with its own driver, can be connected with the master control computer. Doubling or even multiplying the number of networks can not only be used for overcoming compatibility problems. For example, if the system is with a single network 350, such problems can be reduced (or even fully eliminated) by employing a second network (see also the comments in the introduction pertaining to the transmission capacities of present interfaces).

FIG. 14 shows a further modification of the arrangement in accordance with FIG. 12, whereby in this case a single network 350 (shown) or a plurality of networks (not shown) may be used. Elements in FIG. 14, which are identical with the elements in FIG. 12, bear the same reference numerals in both Figs.

FIG. 14 shows a further driver 410 which serves as interface between the network 350 and the control unit of a further machine 400. This machine 400 is concatenated with the machine which is controlled by computer 390. For example, if the said machine is a mixing machine, machine 400 may be a bale opener or a card feeding machine. Driver 396 is also linked with an additional sensor 397 which is not provided in its "own" machine, but in the next machine 400 of the "chain" and which informs its "own" machine control unit (the computer 390) about the condition of said machine 400. It is obvious that several such additional sensors may be provided in other machines or various other machines of the chain.

By means of such "spying sensors" every partly autonomous control unit is able to verify every instruction given by the computer 340 for inconsistencies. What is even more important is the fact that the partly autonomous control units will remain functional even if the network 350 or the master control computer 340 has a defect. The efficiency of the plant will surely be reduced by this. However, it will remain in operation (although not optimally).

Figure 15:
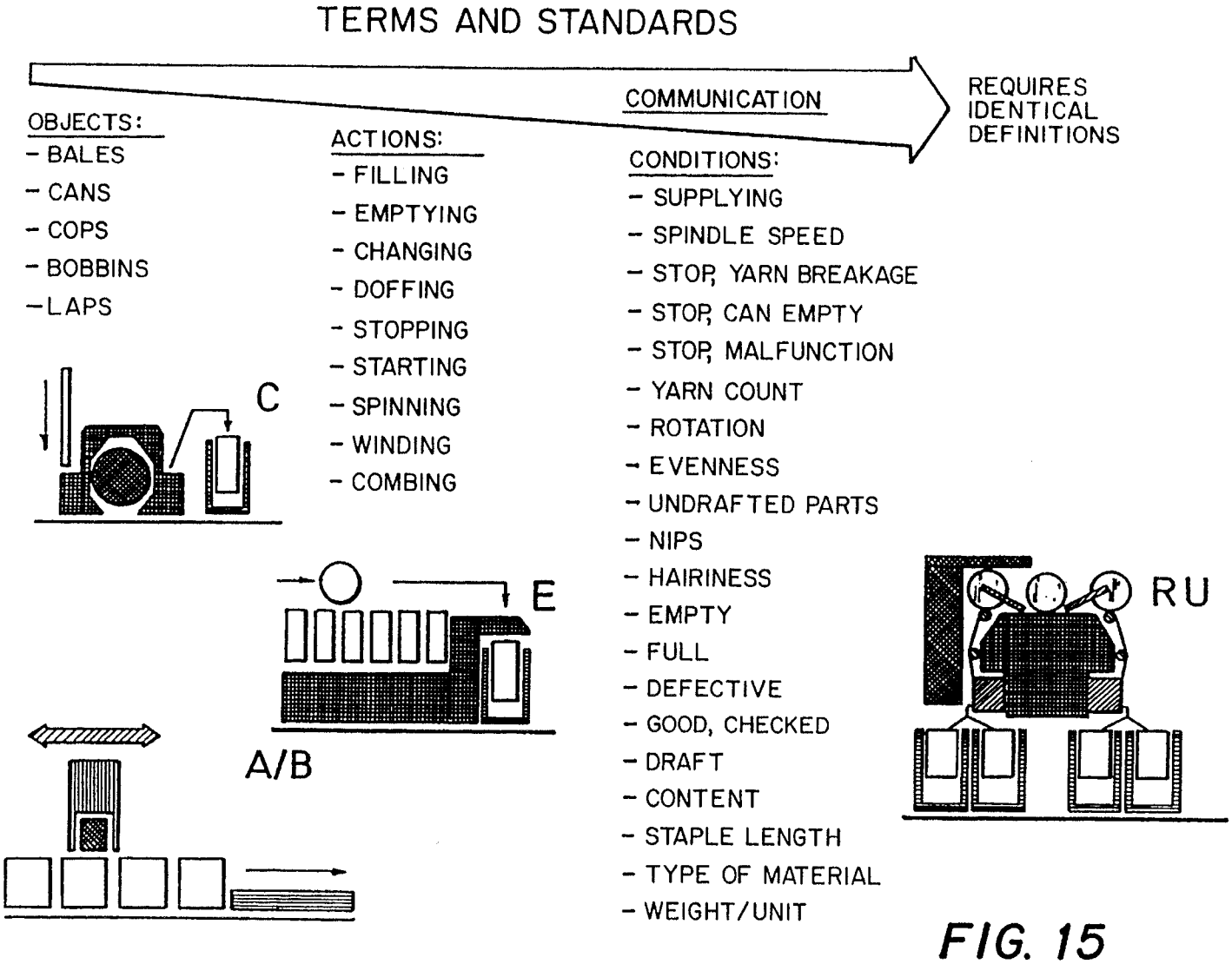

FIG. 15 schematically shows various terms and conditions which have to be standardized for the widespread use of process control systems. These conditions should definitely be taken into account when determining the required sensor units. Diagram A/B indicates to a bale opener, C to a card, E to a combing machine and RU to a rotor spinning machine.

The application of a process control system in accordance with the present invention will be described below in greater detail in connection with ring spinning serving as an example. The machine will be described first.

THE RING SPINNING MACHINE (AND ITS AUXILIARY DEVICES)

The ring spinning machine is used in the present application as the example of a "longitudinal pitch machine". Other longitudinal pitch machines are flyers, the spinning machines for the new spinning processes (rotor spinning machines, jet spinning machines), winding machines, doubling frames (for example, two-for-one twisters) and false twisters for processing endless filaments.

The general principles of a modern ring spinning machine are outlined in the article "Die automatisierte Ringspinnmaschine" (The Automated Ring Spinning Machine) by FR. Dinkelmann, which was presented at the Reutling Spinning Colloquium on Dec. 2 and 3, 1986

Figure 16:
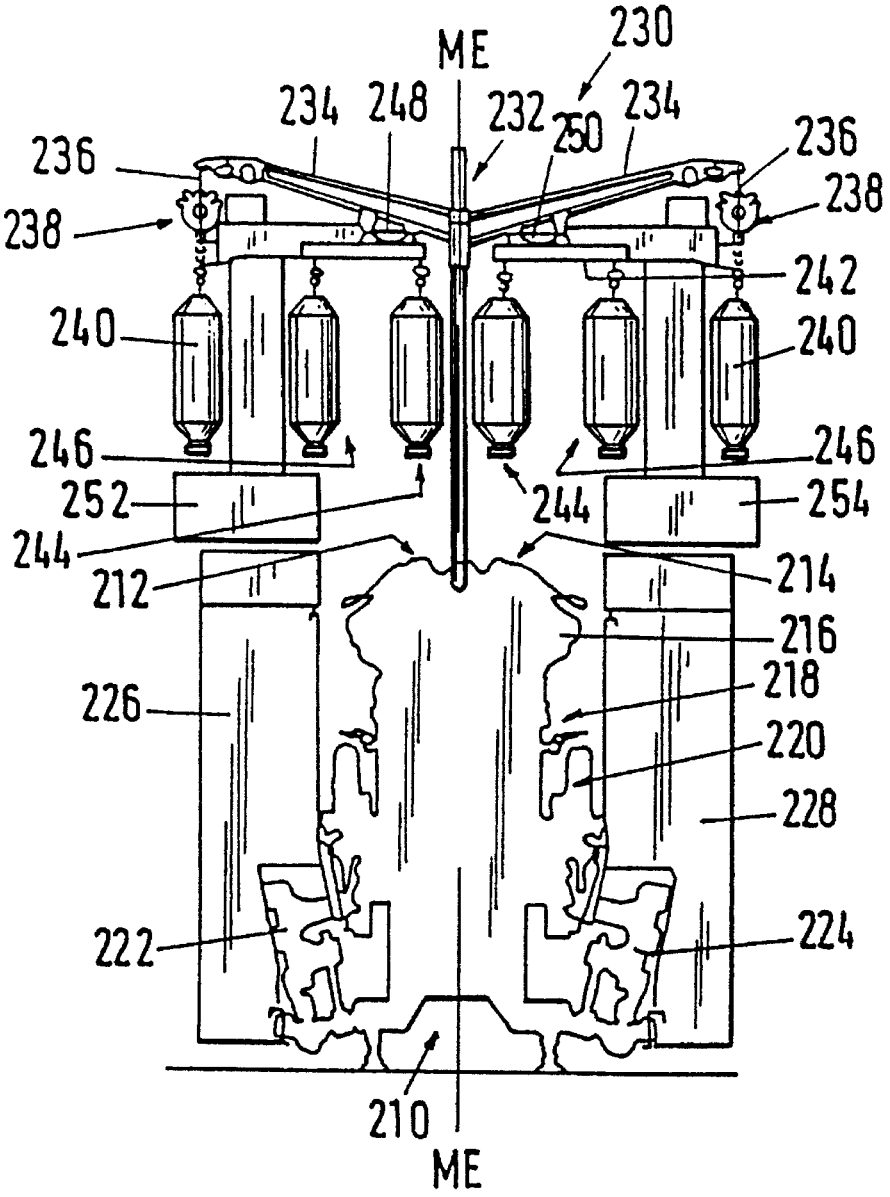
FIG. 16 shows a schematic cross section through a ring spinning machine with some auxiliary devices.

The machine according to FIG. 16 comprises a double-sided frame 210 with two rows of spinning positions 212 and 214 which are arranged symmetrically along the central plane ME of the machine. In a modern machine, each of the rows of spinning positions 212, 214 comprises between 500 and 600 spinning positions narrowly arranged next to one another. Each spinning position comprises a drawing frame 216, yarn guiding elements 218 and a cops-forming unit 220. Unit 220 comprises individual processing elements such as, for example, spindle, ring and travellers. However, they are not of importance for the present invention and therefore are not shown individually. These elements are known to the man skilled in the art and from EP-A 382943, for example. For each row of spinning positions 212 and 214 there is provided an automatic doffing apparatus 222, 224 which simultaneously serves all spinning positions of the spinning position row to which it is allocated. This automatic device will not be explained herein in greater detail because the details thereof are disclosed in EP-A 303877

Each row of spinning positions 212 or 214 is at least also allocated to an automatically operating device or robot 226 or 228, which device is moveable along the respective row and which can automatically carry out operating actions at the individual spinning positions. Details of such an operating device are known, for example, from EP-A 388938.

Frame 210 carries a creel 230 which is formed by vertical rods 232 and lateral beams 234. Rails 236 are mounted at the outer ends of the lateral beams 234 and extend in the longitudinal direction of the machine. Each rail 236 is used as guiding rail for a trolley rail 238 which supplies new bobbins 240 to creel 230. Details of such a trolley rail are shown in EP-43 12 68.

Creel 230 also comprises carrier 242 for supplying bobbins 244, 246. They supply the individual spinning positions with roving yarn. Carriers 242 are shown as lateral rails. However, this arrangement is not of importance for the present invention. In the example in accordance with FIG. 16, the supply bobbins for each row of spinning positions 212 or 214 are arranged in two rows, namely, in an inner row 244 adjacent to the central plane ME and an outer row 246 which is at a distance from the central plane ME.

The lateral beams 234 also carry at each side of the machine a rail arrangement 248 or 250 which is used as a guiding rail for a respective moveable robot 252 or 254. The robot 252 or 254 thus runs between the outer row of supply bobbins 246 and the new bobbins 240 carried by the trolley rail 238 and above the respective operating device 226 or 228. Robot 252 is designed for carrying out the operation of the two rows of supply bobbins of the creel, as was explained in our PCT Application No. PCT/CH/91/00225. This robot is designed for handling the slubbing in such a way that after changing a bobbin in the creel, the slubbing of the new bobbin is threaded into the drafting device by the robot.

CONVEYING DEVICES

Figure 17:
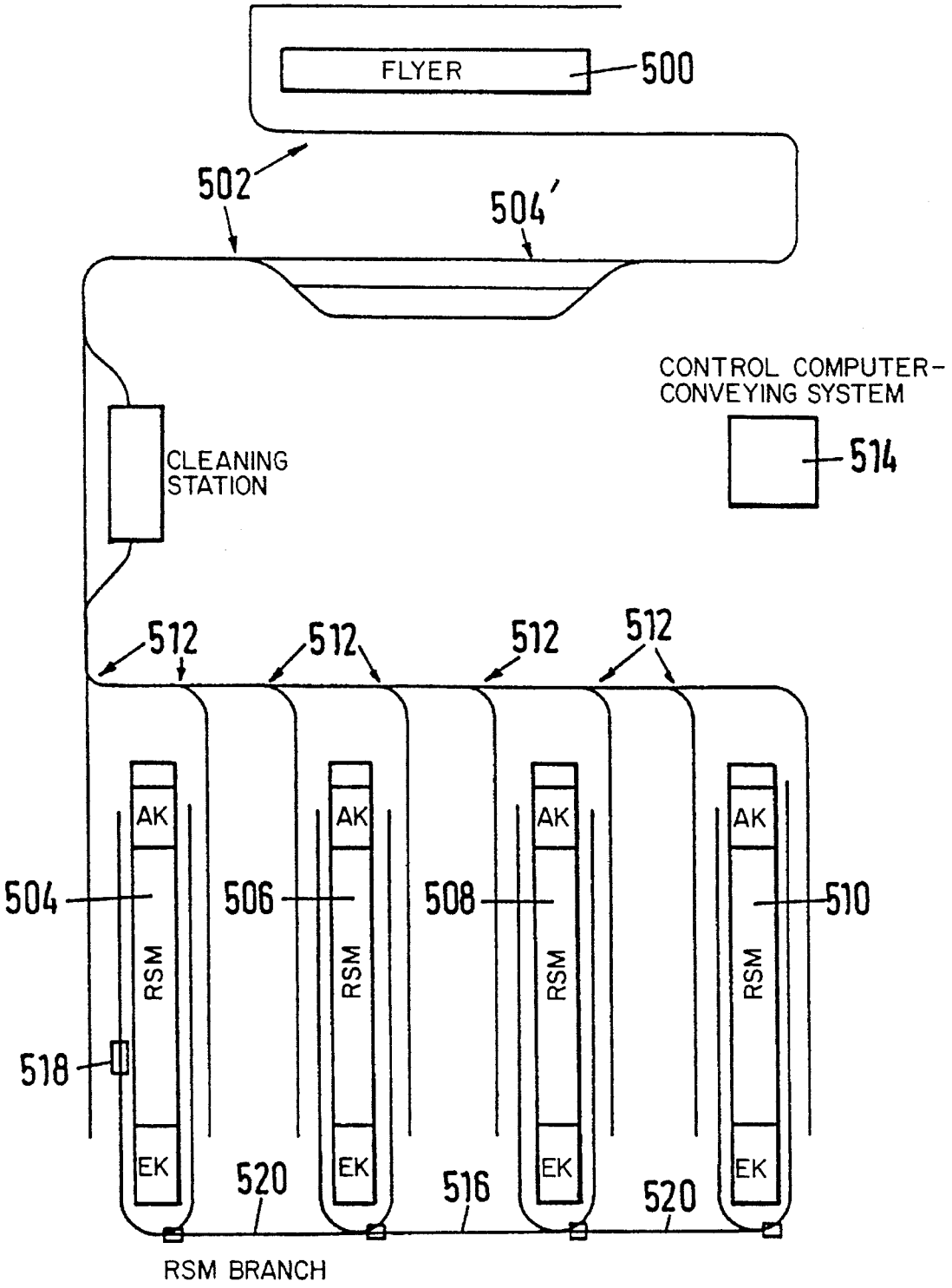
FIG. 17 shows a schematic layout of a spinning room which comprises robots as auxiliary devices.

FIG. 17 shows an example for the layout of a spinning room of a ring spinning plant which is operated by a robot in accordance with the PCT Application No. PCT/CH/91/0225. The diagram of FIG. 17 should explain the supply of feed material to be processed in a spinning machine. A flyer 500 supplies bobbins to four ring spinning machines 504, 506, 508 and 510 via a rail network 502 (with buffering paths 504') for trolleys (not shown). AK indicates the driving head for each machine and EK the end head (at a distance from the driving head). By switching the branches 512 it is possible to direct a trolley to any desired side of the machine. Each machine is therefore allocated to a U-shaped section of the network. The conveying device is controlled by a master computer 514 of the conveying network between flyers and ring spinning machines as shown in European Patent Application No. 43 12 68.

A railway network 516 is also provided for the bobbin changing robot/slubbing handling robot 518, which is equivalent to the robot 252, 254 in accordance with FIG. 16. The network 516 comprises for each machine a respective U-shaped section which is, however, opposite of the respective U-shaped section of the conveying network 502. The robot 518 can be guided from one machine to another via connection sections 520.

Bobbin changing operations are preferably carried out according to a predetermined "exchange strategy", an example of which is described in PCT Application No. PCT/CH/91/00225. According to this strategy, the changing operations are alternatively carried out on the one or the other side of the machine so as to reduce the work load of the operating devices 226, 228 (FIG. 16). It is necessary during the new threading of the drawing frame to always coordinate a bobbin changing operation with the elimination of a yarn breakage, so that while the bobbin is changed the operating device 226 or 228 should always be present near the affected spinning positions. Naturally, this means that the operating device is not available for operating other spinning positions, although other possible malfunctions (that might require the elimination of yarn breakages) may occur at such positions.

The preferred machine arrangement thus comprises at least two operating devices (FIG. 16) which are each allocated to one side of the machine. Whereas one operating device may be used to cooperate in the bobbin changing operation on the one side of the machine, the operating device on the other side of the machine is free to operate the spinning positions which do not require a bobbin changing operation.

The demand (in the form of a signal) for supplying a fully loaded trolley rail from the conveying device to a predetermined ring spinning machine is preferably generated by the machine itself (according to EP-392482, for example). In this case, the positioning of said trolley rail with respect to the ring spinning machine depends on the overall arrangement. It could be provided, for example, that a whole side of the machine is provided with trolley rails each time when bobbin changing operations are to be carried out by the robot. The information concerning the creel positions to be provided with trolley rails should be present in the ring spinning machine or in the robot (more than in the central control unit 514 of the conveying device).

In the more probable case that the trolley rail is shorter than the overall length of the machine and that the bobbin changing operations are carried out in groups, each trolley rail must be placed and fixed at a suitable position with respect to the ring spinning machine. In this case, it is preferable to define an interface between the control unit 514 of the conveying device and the control unit of the ring spinning machine, so that the movement of the trolley rail from this interface will be assumed by the ring spinning machine control unit (according to EP 392482, for example). The suitable position information can either be supplied by the robot to the ring spinning machine or it can be present in the ring spinning machine control unit and transmitted to the robot.

The initiation of a bobbin changing operation can be calculated by the ring spinning machine either in accordance with time or (preferably) in accordance with the supplied slubbing quantity (i.e., depending on the machine speed).

Whether the arrangement in accordance with FIG. 17 (with a connection for the robot between two and more (in FIG. 17 four) machines) is possible or not depends on the frequency of the bobbin changes, which depends on the yarn count. If the connection is possible, the transfer from one machine to another should be coordinated by the master control unit 514 of the conveying device depending on the supply of the machine with trolleys.

A spinning machine not only requires a conveying device for supplying feed material, but also for further conveying the products of the spinning machine itself. Most modern ring spinning machines are presently equipped with two conveying belts in accordance with FIG. 18. Each spindle row is allocated to its own belt provided with journals. The empty bobbins are each supplied by the movement of the belt on a journal in the longitudinal direction of the machine to the automatic doffing apparatus and thus to the spinning positions. The same or other journals attached to the belt are used for discharging the full cops after having been removed by the doffing apparatus from the spinning position. Examples for such systems are shown in U.S. Pat. No. 3,791,123; CH 653378 and EP 366048. Newer systems based on the so-called peg trays are disclosed, for example, in the European Patent Application No. 45 03 79.

The spinning machines pursuant to the newer methods require other conveying means, for example, for conveying cans to the rotor spinning machine or for further conveying cross-wound bobbins from the rotor spinning machines. Examples of such systems are disclosed in DE 4015938.8 of May 18, 1990 (can supply) or DOS 4011298 and DOS 4112073 (cross-wound bobbin conveying system).

THE ACTUATORS OF THE (RING) SPINNING MACHINES

The actuators of the machine comprise both built-in as well as mounted elements and aggregates. The actuators for the built-in elements at least comprise the drives for the spindles, drawing frames and the ring rail. A system with modern design (single drive) for driving the spindles, the ring rail and the drawing frames of a ring spinning machine is shown in EP 349831 and 392255. According to these, its own drive motor is provided for each spindle and also for each row of drawing frames. The presently most widely used driving system (central drive) for ring spinning machines comprises a main motor in the driving head of the machine and transmission means (e.g., longitudinal shafts, belts and toothed wheels) for transmitting the driving forces from the main motor onto the driving elements.

In a machine in accordance with FIG. 16, it is necessary in any case to provide an additional motor for each of the doffing apparatuses 222, 224. The actuators for the built-in elements also comprises the drives of the conveying devices for cops (in accordance with DOS 3610838, for example) or for empty bobbins in the creel (in accordance with WO 90/12133, for example). The mounted auxiliary aggregates naturally comprise both the robots 226, 228 and 252, 254 as well as conveying trolleys 238 which, for the time being, are positioned near the machines. Further examples of such aggregates are cleaning robots, blowers and other moveable automatic devices which are used, for example, for changing travellers.

Some of these aggregates have their own drives (moveable automatic operating devices). Others possibly have no own drive, but depend on a drive which is built into or mounted on one of the machines (see, for example, the trolley drive in accordance with FIGS. 16 to 18 of WO 90/12133) or a drive in accordance with the European Patent Application No. 42 11 77. The drives of such auxiliary aggregates may also be regarded as actuators of the spinning machine as long as they can be influenced by the control unit of the machine.

Important actuator elements are those which are used to "stop" a spinning position, whereby the term "stop" is understood as "effectively stopping a producing spinning position". In most cases, not all processing elements of a spinning position are stopped during the stopping of an individual spinning position. Mostly, only the spinning is stopped. For example, this can be made by interrupting the material supply and/or by willfully generating a yarn breakage.

In a more or less fully automated machine (the rotor spinning machine, for example) this can be easily carried out by a central machine control unit by means of the one or the other method. For example, the drive can be interrupted in the feed roller so as to interrupt the supply of material to the opening cylinder or the rotor of the spinning position. It is also possible to carry out a so-called quality cut in the quality control of the spinning position or winding position so as to interrupt the course of the thread. In rotor spinning machines or jet spinning machines, such a "cut" can be caused by willfully interrupting the feed of material.

In present conventional ring spinning machines, such possibilities are no longer available, because the actuators of the individual spinning positions are no longer under the direct control of the central machine control unit. It is possible, however, in such machines to stop a spinning position by employing a moveable auxiliary aggregate, for example, in accordance with the system of the European Patent Application Nos. 388938, 394671 and 419828, i.e., by actuating a slubbing clamp to interrupt the supply of material.

The utilization of a slubbing clamp for interrupting the material supply will be important in all types of machines where the feed material is supplied via a drawing frame to the spinning positions, because it is usually impossible to turn off a single position of a drawing frame. It is also possible to provide the slubbing clamp of each spinning position with an actuating apparatus. These can also be actuated by a central machine control unit. Examples of such slubbing clamps are shown in EP 322636 and EP 353575.

THE CONTROL UNIT OF THE SPINNING MACHINE AND ITS AUXILIARY AGGREGATES

Present conventional ring spinning machines (with central drive) usually comprise a central microprocessor control unit which generates suitable control signals for the central drive system (usually by controlling frequency converters). A single drive system may, for example, also comprise a "distributed" control system according to EPO 389849. Novel spinning machines (rotor or air spinning machines) are always provided with distributed control units (see, for example, EP 295405 or the article "Mikroelektronik—heutige and zukunftige Einsatzgebiete in Spinnereibetrieben" (Microelectronics Present and Future Fields of Application in Spinning Mills) as published in Melliand Textile Reports June 1985, pages 401 to 407), whereby the distributed control units should practically comprise a central coordinating machine control unit. The same applies to winding machines (see, for example, the article "Der Beitrag elektronisch gesteuerter Textilmaschinen zur betrieblichen Informationstechnik" (The Contribution of Electronically Controlled Textile Machines To Applied Computer Engineering in the Plant) by Dr. T. Ruge (Reutling Spinning Colloquium Dec. 2 and 3, 1987).

The moveable auxiliary aggregates each have their own autonomous control unit (see, for example, EP 295406, EP 394671 or EP 394708). Although these control units work autonomously, each of these is subordinate to the machine control units in a hierarchical manner. In an impending doffing process, for example, the robots 226, 228 are seconded away from the processing areas of the automatic doffing apparatuses 222, 224 by the coordinating machine control unit (in accordance with DOS 2455495, for example).

Control unit 514 of FIG. 17 is also to be regarded as a "machine control unit", i.e., the conveying device which connects two processing stages can be regarded as a "machine" from an organizational point of view. This does not apply if the respective device is built into a machine or if it is hierarchically subordinate to a machine control unit.

THE SENSOR UNITS OF PRESENT (RING) SPINNING MACHINES

In comparison with machines for the new spinning processes (such as rotor or jet spinning machines), the sensor units of present ring spinning machines are very rare. For example, the rotor spinning machine has long been provided with sensor units which both provide information about the condition of the individual spinning positions as well as the quality of the yarn produced therein (see EP 156153 and the state of the art mentioned therein; concerning modern supervision, see "ITB Garnherstellung" January 1991, pages 23 to 32.4). Similar systems have also been developed for filament processing and false twist machines (see, for example, DOS 3005746). The winding machine which processes cops of ring spinning machines into cross-wound bobbins is provided already now with sophisticated sensor units (see, for example, DOS 3928831, EP 365901, EP 415222 and U.S. Pat. No. 4,984,749).

Proposals have been made according to which ring spinning machines would also be provided with a highly developed internal communication system and respective sensor units (see, for example, EP 322698 and EP 389849 (=DOS 3910181). Such proposals require—for their realization—a review of the whole ring spinning machine, which could only be made step by step due to the costs arising therefrom and the respective effects on the competitiveness of the method.

In the near future, the ring spinning machine will therefore not be provided with an internal communication system. Information about the conditions of the individual spinning positions will therefore have to be collected by moveable monitoring devices instead of individual sensors at the spinning positions. Such devices have been known for a considerable period of time (from DOS 2731019, for example). A later variation in which the monitoring system is integrated in a yarn breakage elimination device has been shown in EP 394671 (=DOS 3909746). Further sensors of the ring spinning machine, which are important for feeding the creel, are shown in WO 90/12133, for example. Further sensors are required for the operation of the cops conveying device or empty bobbin conveying device, whereby such sensors are known and therefore do not require further description (see, however, DE patent specification 3344473)

Note must be taken of the fact that the sensor units of the spinning machine can also be mounted instead of being built in. An example for such a system is shown in the article "Uberwachung der Qualitat von OE-Rotorgarnen" (Supervision of Quality of Open-End Rotor Yarns) in "ITB Garnherstellung" January 1991, pages 23 to 32.

Irrespective of whether the spinning machine is provided with built in or mounted sensor units, it will at least be provided with certain sensor elements which supply its output signals to the machine control unit. Such "machine-internal" signals produce an image of the "condition" of the machine. They provide answers to questions that are important for "safety" such as, for example:

- does a moveable device presently stand or move in an area where collisions could occur with another machine part (such as a doffing apparatus, for example)?
- are physical thresholds exceeded which could lead to damage (e.g., speed, bearing temperatures, current values)? (see DOS 4015483, for example).
- is there a person or an obstruction situated in the path of a moveable part?
- has an operation been started in the machine which must not be interrupted instantaneously?

The respective sensors can also be designated as the safety sensors of the respective machine. Here, the sensors may be installed in a neighboring machine or a conveying system. It is important that the sensor signals are transmitted to the respective machine control unit.

CONTROL OF THE WHOLE PLANT

The spinning room represented in FIG. 17 only shows a part of the whole plant. A complete spinning mill is shown, for example, in DOS 3924779. Other examples are disclosed in the following articles:

- "Uberwachung der Qualitat von OE-Rotorgarnen" (Supervision of Quality of Open-End Rotor Yarns) in "ITB Garnherstellung" January 1991, pages 23 to 32.
- "Vergleich von Anforderungsprofil und Realitat fur eine automatisierte Spinnerei" (Comparison of Requirements for and Reality of an Automated Spinning Mill) in "Textilpraxis International", October 1990 (from page 1013).

The control of the whole plant is designed in such a way that the processing stages are "concatenated". If the transport between the processing stages is automated, the signals from a "source" (the supplying machine) and a "target" (the machine to be supplied) can be processed by the control unit of the conveying system into a "conveying instruction". This instruction will be transmitted to a conveying unit (provided, however, that a free loaded conveying unit is available). If certain operations are not automated yet, they have to be carried out by an operator.

Before a machine carries out an action through the actuators it checks by means of the image conveyed by the safety sensor units whether such an action can be carried out without any danger and without causing any damage.

The concatenation of the processing stages of a spinning plant, with or without operator interventions, has substantially been solved at the "machine level". Examples can be seen in the state of the art as mentioned above. The concatenation of the plant by conventional or even further developed combinations of actuators/sensors/control unit at machine level (i.e., without the process control computer) is preferably maintained, so that the plant can continue to function without the process control computer in the event of a breakdown of the process control computer, albeit with reduced performance.

THE PROCESS CONTROL COMPUTER

In accordance with the present invention, a process control computer is superimposed on the individual machine control units, which would fully suffice for the autonomous operation of the plant, so as to form a process control level. FIG. 19 shows a respective arrangement, which is designed as a modification of the plant in accordance with FIG. 14.

FIG. 19 schematically shows the connection of the process control computer with individual machines. The principles thus illustrated also apply to the connection with further machines or all machines of the whole plant. FIG. 19 schematically shows a possible variation of the architecture for a process control with the master computer 340, the network 350, the computers 390 and 410, previously described in connection with FIG. 14. Each computer 340, 390 is provided with the respective memory 343, 345 or 391 and drivers 347, 349 (FIGS. 14, 19) or 393, 394 (FIG. 14) or 395, 396 (FIG. 14) allocated to each of said computers, whereby FIG. 19 no longer shows certain elements, because they already have been shown in FIG. 14. Such a process control can be provided for the whole plant or a part thereof (e.g., for the spinning room in accordance with FIG. 9 or FIG. 17).

Additional drivers 412 or 416 determine the required interfaces for the communication between two additional computers 414 or 418 and the network 350. Both additional computers 414, 418 are provided with drivers (not shown) which determine the interfaces between the respective computer 414, 418 and the display and the operating elements, whereby only the display 420 and the operation 422, which are connected to the computer 414, are shown.

Computer 418 controls an air conditioning system which conditions the room in which the machines controlled by computers 390 and 410 are located. This system has nothing to do with the processes per se, but it controls the environment in which said processes take place and have a decisive influence on the results thus obtained. The air conditioning system is provided with a sensor unit which is schematically represented in FIG. 19 by a sensor 424.

Computer 414 controls a data acquisition system which is mounted on the machine controlled by computer 390. The data acquisition system comprises sensor units which are represented in FIG. 19 by sensors 426 and 428. The sensor units of the acquisition system collect measured data on the conditions in the machine controlled by computer 390. However, they do not supply the respective output signals (raw data) to the computer 390, but to computer 414. Said computer may (but need not) have a connection 430 with computer 390, which will be outlined below in greater detail. However, it nonetheless supplies the obtained raw data to computer 340 via network 350.

The process control computer 340 can now transmit control instructions via the network 350 to computer 390 and/or computer 414. If such control instructions are received by computer 414 and if they pertain to the data acquisition system, no communication is required via connection 430. If such instructions pertain to the actuators of the machine itself, it is necessary that they are transmitted via connection 430 to the machine control unit 390 if they are received by computer 414. Such an arrangement is not desirable, because the process control computer 340 preferably communicates with computer 390 directly. This arrangement, however, is not excluded from the invention and could prove to be necessary if the "cooperation" of the data acquisition system should be necessary to convert the results obtained from the data into control instructions for the machine. For example, this could be the case where the data acquisition system (maybe in form of an add-on) is provided by a supplier who does not supply the machine itself, or where an autonomous operation of the system part 390–414 occurs, for example in the winder (390) and yarn cleaner (414) for the message "yarn cut".

FIG. 19 shows a further computer 432 which is allocated to computer 390. Computer 432 controls, for example, an operating device which is permanently allocated to the machine which is controlled by computer 390. Computer 432 cannot communicate with the process control computer 340 directly, but only through computer 390. Computer 432 receives control instructions from computer 390. Otherwise, it works as an autonomous unit. It controls own drives 434, 436 and has its own sensors 438, 440. The sensor 438 is provided for monitoring an operating condition of the autonomous unit (the operating device). Sensor 440, on the other hand, monitors a condition of the machine controlled by computer 390. The raw data of sensor 440 are thus transmitted either continuously or intermittently to computer 390.

A sensor 442 disposed in the machine could be provided for monitoring a condition of the autonomous unit. Its raw data would not have to be transmitted to computer 432, but could influence the control instructions issued to it.

The connection 444 between computers 390 and 432 would not have to exist continuously. A suitable connection between the control unit of a ring spinning machine and a piecing robot subordinate to one of these machines has been shown in our European patent application no. 394671. Computer 432 (like computers 390 and 414) may be provided with its own display and operating elements (not shown in FIG. 19).

EXCEPTIONAL CONDITIONS (UNCOUPLING, SWITCH OFF, BREAKDOWNS)

As was mentioned in the introduction, it is sometimes important or desirable to uncouple a machine from the process control system. This is schematically shown in FIG. 19 by the "switches" 446, 448 that are not "free" and that can only be actuated under certain circumstances, as is schematically indicated by keys 450. This representation shall only apply to the explanation of the principle. It is not necessary to interrupt the connection with the network to bring about the uncoupling. The uncoupling, irrespective of the manner by which it is effected, may only be carried out under controlled circumstances (by specific persons).

A machine that was uncoupled from the process control computer comes under the full control of the operating personnel again. It is possible that, for example, maintenance work or trials (irrespective of the system controlled) are carried out.

The uncoupling of a machine has to be reported to a process control computer, and has to be carried out in such a way that the machines concatenated with the uncoupled machine can still be controlled by the process control computer.

Preferably, such an "uncoupled" machine is not fully isolated from the process control system. It continues to report information concerning its condition to the system, but no longer reacts to control instructions of the respective control computer. The "switch" acts in a certain way as a "diode", which allows signal transmission only in one direction.

In a preferred embodiment, the communication between the machine control unit and the process control computer continues to function even after the "switch" has been actuated; the machine control unit, however, has been converted in such a way that it no longer forwards control instructions from the process control computer (after the switch has been actuated) to the actuators, but only control instructions which have been entered via the operating controls.

In any case, it is desirable that operator support is maintained by the process control computer, even for a machine that has been "uncoupled" by the process control system. This naturally does not cause any major problems if said support is provided by the user interface of the machine and if the communication between the machine control unit and the process control computer is also maintained during the uncoupling of the machine from the process control system. The machine control unit can then forward instructions from the process control computer to the user interface, but it will keep instructions from the master computer away from the machine actuators until the uncoupling has been removed. In particular, it should be possible for the process control computer to indicate through the operator support that the recoupling of the uncoupled machine is "desired", because, for example, the production of the machine is required for fulfilling an urgent production order.

From time to time, it is also necessary to "switch off" a machine for carrying out certain works such as, for example, certain maintenance works or changing assortments. In these cases, operator support by the process control computer should also be available, even if said support is provided through the user interface of the machine. Preferably, suitable switching means (e.g., in connection with the machine control unit) should be provided to switch off the actuators (or predetermined elements thereof) without interrupting the communication between the process control computer and the user interface (or other supportive means).

Therefore, means may be provided to continue to operate an uncoupled machine in a number of ways such as, for example, in "normal operation" (but without the function of the process control computer) or in "service operation". It would also be possible to provide various "keys" to set the machine to either the one or the other operating condition.

In all of said cases, the conditions of the machine will be preferably continued to be reported to the process control computer.

Image of the Condition/Safety Conditions

Every machine control unit as well as the process control computer will store an image of the respective controlled part of the plant. The process control computer, however, has to process much more data than a machine control unit which is controlled by said process control computer. As the processing (evaluation) of the data will require a certain amount of time, one cannot assume that a control instruction from the process control computer will adequately take the momentary condition of the controlled machine into account. This is particularly important in connection with the machine's safety condition. The "responsibility" for the safety has thus been delegated to the machine control level.

The safety substantially depends on the movements of the machine parts. These movements determine geometrically definable "fields" or (three-dimensional) "spaces". It is therefore possible to allocate the responsibility for a predetermined safety field or safety space to a specific control unit. This principle will be explained in greater detail below by reference to FIG. 20, whereby two-dimensional fields shall be used as examples.

Figure 20A:
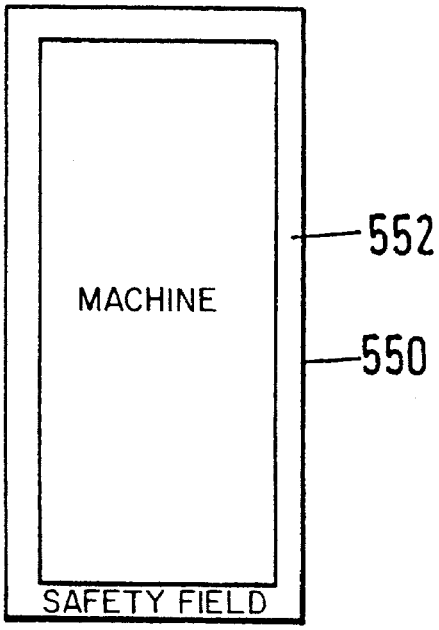

FIG. 20A shows the simplest example: the "safety field" 550 of a machine 552 encompasses the machine at a given distance, which takes into account the maximum expansion of moveable machine parts (such as doffer beams 222, 224, FIG. 16, for example). Within said safety field all moveable elements subjected to the machine control unit are allowed to move (such as the operating robot, for example).

Figure 20B:
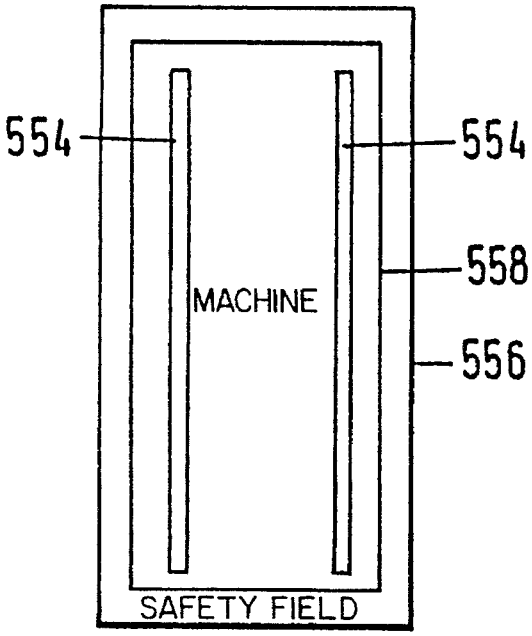

FIG. 20B shows a somewhat more complex variation where "enclaves" 554 are provided within the safety field 556 of a machine 558. Such "enclaves" form the safety fields of another control unit or other control units, for example, a moveable sensor unit mounted on the machine (see, for example, the article "Wirtschaftliche Prozessdatenerfassung mit dezentralen Subsystemen" (Commercial Process Data Acquisition with Decentralized Subsystems) by H. Howald, Textil Praxis International of March 1983, page 230 ff) or an apparatus integrated in the machine and controlled separately (for example, a yarn cleaner in a winding machine; see for example WO 85/01073).

Figure 20C:
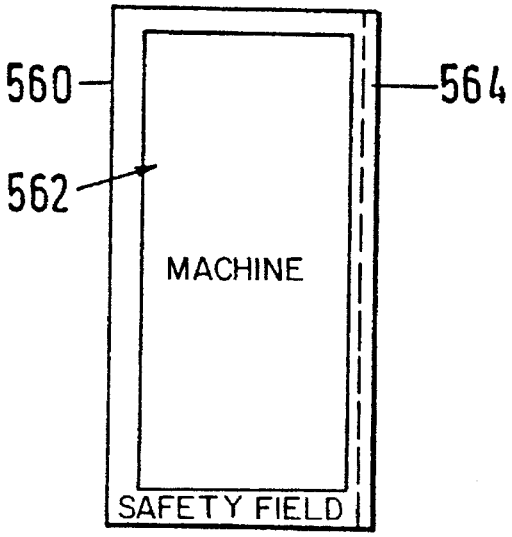

FIG. 20C shows a further complication, i.e., where a moveable element (such as a conveying trolley) has to "penetrate" the safety field 560 of a machine 562 from time to time. The following options may be provided:

1) the "safety" responsibility" for the trolley is "transferred" to the control unit of the machine whenever the new element penetrates the respective field;
2) the machine control unit releases area 564 of its safety field 560 for the penetration of the new element, and the safety responsibility for this area will thus be "assigned" from the machine control unit to the control unit of the moveable element.

Figure 20D:
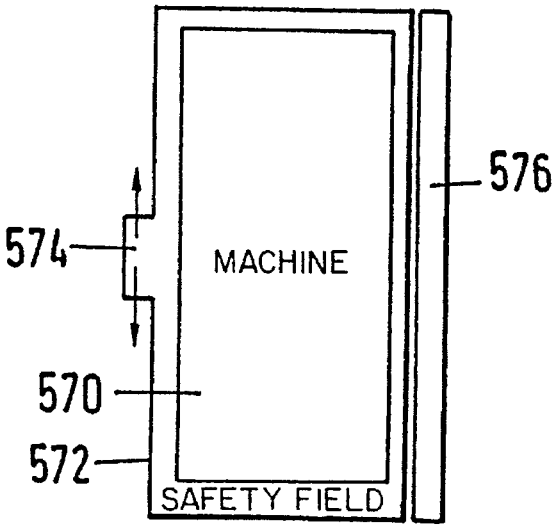

Finally, FIG. 20D shows a variation in which a machine 570 is provided with a "changeable" safety field 572, because, for example, said field comprises a moveable expansion 574 according to a moveable robot. A second element (a blower, for example) comprises a safety field 576 which is usually adjacent to field 572, whereby, however, an overlapping comes about if the "expansion" 574 of field 572 threatens to penetrate field 576. In this case, it may be provided that either the one or the other moveable element has an "avoidance duty".

FUNCTION OF THE PROCESS CONTROL COMPUTER AND REQUIRED DATA

The functions of the master computer should be limited with respect to the functions of the data acquisition system, whereby the master computer may also fulfill acquisition tasks. Data acquisition has the task of providing a meaningful overview. Possibilities are shown, for example, in the article "Prozessdatenerfassung in der Ringspinnerei—Anwendung und Weiterverarbeitung der Prozessdaten yon Uster Ringdata am praktischen Beispiel" (Process Data Acquisition in Ring Spinning—Application and Further Processing of Process Data of Uster Ringdata in a Practical Example) by W. Schaufelberger. The article was presented in the Reutling Spinning Colloquium of Dec. 2 and 3, 1986.

The function of the master computer in the spinning mill depends on the task it is given by the user. For example, this task may consist of optimizing the plant, which is principally operable in an autonomous manner, on the basis of a predetermined strategy. Another task may consist of maintaining the plant in an operable condition over longer periods without operator intervention. This includes both disposition tasks as well as maintenance tasks.

To control a yarn-producing system in this manner, the master computer requires, for example, the following information:

- the operating conditions of the individual spinning positions ("in operation"/"stopped" and possibly the reason for the stoppage); this information is used for calculating and monitoring the whole production of the plant during a given interval;
- the "quality" of the manufactured product of the individual spinning positions, i.e., for each spinning position there is information whether or not the yarn produced at this spinning position lies within the predetermined tolerance thresholds;
- the different types of yarn that are produced at the individual spinning positions; this is used for extrapolation and monitoring the completion of given batches (orders).

Presently, there are no sensors or combinations of sensors that are able to specifically determine the yarn type of a running spinning position. This information must be entered by the operators. Such settings will not be treated hereinunder. For further information refer to our Swiss patent application No. 1374/91 of May 7, 1991, for example.

As was already mentioned in the previous chapter "Sensors", spinning machines of the newest spinning methods (rotor spinning, jet spinning) are usually in the position to provide the required information to the process control computer themselves, at least in the sense that the information is available in the machine itself. Present ring spinning machines, however, are only able to provide the required information with the help of auxiliary aggregates, whereby quality information from the yarn cleaners of the winding machine have to be included too (see EP 365901, for example). Our Swiss patent application No. 697/91 of Mar. 7, 1991 shows one possibility to optimize the cooperation between the automatic operating devices of the ring spinning machine and the yarn cleaner of the winding machine in that the information bases of the two machines are exchanged.

The process control computer thus preferably has access to the raw data of the sensors in the plant which are important for it and the machines which are controlled by it via the communication network or its communication networks. The raw data comprise the full information about a specific sensor (which is important for the process control system), which, if necessary, are prepared in such a way that misinterpretations are avoided. As an example, it is assumed that the yarn breakage sensor signals a yarn breakage at a certain spinning position. From this signal a yarn breakage can only be inferred if the spinning position (or the machine) is "in operation", which has to be considered by a further signal (or further signals) in the signal conditioning.

PROCESS CONTROL SYSTEM/MACHINE CONTROL UNITS

The invention is based on a clear "distribution of tasks" between the process control system (process control computer) and the machine control units.

It is the object of the process control system "to act in a foresighted manner" (on the basis of a predetermined "strategy"), i.e., the process control system must be capable of recognizing trends and tendencies in the course of the process within the whole plant and optimizing individual scheduled values with respect to the strategy. To meet these requirements, the process control system (process control computer) requires information with respect to the operating condition of each processing position within the plant. This makes great demands on the information transmission capacities of the network or networks between the machines and the computer. The process control computer need not be informed continuously about the present status of the machine. It is insensitive to delays in data transmission, provided, however, that the delays allow recognizing the trends early enough that the process control system can take corrective action, if required.

In contrast to this, it is not the object of the process control computer to control every single operation in the plant. This is a task to be fulfilled by the machine control units, which each require the storage of an image of the momentary condition of the elements and aggregates controlled by said units. The process control computer has stored an image of the overall system which must represent the momentary condition of all data relevant to the process control computer and which must be designed so as to allow the system to determine any changes in condition up to a maximum delay which is determined depending on the fastest expected changes in condition.

Thus, the process control computer is granted access to the raw data of the sensor units of the plant, but no "control authorizations". The process control computer issues control instructions in the terms of scheduled values or changes in scheduled values (such as "premature spinning off") to the machine control units. The machine control units, however, will only forward these as control instructions to the actuators after having been processed by their own control programs and after having taken into account the momentary mapped condition of the elements controlled by them.

PLAUSIBILITY CHECK

The software of the machine control unit must check the plausibility of the control instructions received from the master computer. This applies to all aspects of controllable sequences, so that the machine control unit may receive the "authorization" to "doubt" a control instruction if the instruction given does not match the image of the machine condition stored in the machine control unit. The software of the machine control unit may be designed, for example, in such a way that it will only carry out such a control instruction if it is confirmed by an entry of the operator or if a machine condition is reached that allows the intervention.

A contradiction between a control instruction and the safety condition of the machine (as is mapped in the memory of the machine control unit) must in any case lead to an alarm (even if the command is "confirmed"), because such a situation is excluded from all predefined sequences. The "existence" of the situation thus points out to a dangerous defect in the system.

GENERATION OF CONTROL INSTRUCTIONS

There are two principal kinds of control instructions:

those that can be carried out without operator intervention;

those that can only be carried out with operator intervention.

The effective options in a given case depend on the type of the machine and on the fact of whether or not the actuators of the machine are automatically controllable. In a modern ring spinning machine at least the speed of a main driving motor will be automatically controllable. The draft or the change of the type of traveller will only be possible in exceptional cases or not at all.

If the machine settings can be controlled automatically, the master computer can influence these settings by scheduled values issued to the machine control units and adapt these to the changes in the environment. If, for example, an analysis reveals that the number of yarn breakages in the start-up phase of the cops formation exceeds the determined values that are realistically to be expected (empirically over time), the "speed curve" (FIG. 21) of the machine can be adjusted to reduce the number of yarn breakages in this phase. This curve defines the scheduled values for the speed of the main drive motor (or the individual spindle motors) for the cops formation (see CH 1374/91, for example—compare DOS 4015638).

On the other hand, if it is determined in the winding machine that the yarn nappiness of the set values is not sufficient (traveller change is required) or that the yarn count is even wrong (change of draft is required), the master computer can issue an instruction via network 350 to the affected machine, whereby such an instruction has to be indicated on the user interface of the machine. If the adjustment of the operating conditions should become urgently necessary, the master computer must at the same time issue an alarm call (for example, according to PCT patent application No. WO 91/16481) to the respective staff, so as to draw the attention of the most suitable person to the necessity/type of required new setting (alarm system). The process control computer should not intervene directly in the processing sequences of the process. This is a task to be fulfilled by the machine control units. The influence of the master control computer remains limited to the indirect influence by the machine control units. The influence of the master control computer is an indirect influence via scheduled values and operational support.

BIDIRECTIONAL EXCHANGE OF INFORMATION

It is desirable to limit the number of communication channels to and from the master computer to a minimum. Such channels must meet stringent requirements for the signals to be transmitted, which requires predetermined interface configurations in the network or networks (see, for example, the article "Datenschnittstellen an Textilmaschinen. Zwischenbericht uber die Ausschu tatigkeit der VDI-Fachgruppe Textil and Bekleidung" (Data Interfaces in Textile Machines, Intermediate Report of the Activities of the Committee of VDI Special Group Textile and Clothing), in "Melliand Textilberichte", II/1987, page 825). The requirements are preferably met by signal conditioning in the machine control unit or in a terminal station mounted on the machine. The communication of a machine control unit with its actuators can be achieved irrespective of these requirements, namely (if required) in a different manner for the different actuator elements. The examples mentioned in the present application are an indicator of the diversity of the configurations which can be controlled by a process control computer. In an arrangement in accordance with FIG. 19, it would therefore be desirable, if possible, to carry out the communication with the master computer either via the machine control unit or via computer 414 (but not via both of these). This would allow reducing the number of transmission means in the plant. For an example of present developments of network structures see "PROFIBUS—Systemubersicht fur Planer und Anwender" (PROFIBUS—System Overview for Planners and Users) by Dr. G. Klose in "Chemiefasern/Textilindustrie" of September 1991 (page 1129 ff).

The Communicating Machine

FIG. 22 schematically shows a machine 580 with its own control 582 which controls machine actuators 584 and receives messages (signals, data) from the machine sensors 586. This control unit is provided in the form of a computer with suitable programs (software). The machine is also provided with a so-called "communication board" 588 which is coupled with control unit 582 and comprises a connecting means which is used to couple the board 588 with the communication network. Depending on the design of the network, the connecting means can be formed for connection with a coaxial cable or optical waveguide or with a twisted double wire.

In a preferred embodiment, the network is arranged as a bus and operated according to the so-called "polling method" (time sharing) in which the coupled communication boards are polled one after the other or supplied with data.

Communication board 588 preferably comprises a memory which serves as buffer memory for the supplied data or the data to be transmitted. This buffer memory is preferably "overdimensioned" with respect to normal operation and therefore is able to store the acquired data over a predetermined period which is longer than the polling interval determined by the system. The communication board also comprises the drivers (programs) mentioned above. The board compiles data from the memory into data packages which can be sent through the network to the master computer.

The process control computer and the network is often (usually) supplied and installed by a system supplier. There are two options for determining the interface between the elements supplied by the machine manufacturer and the system. According to a first option, the interface lies between the communication board 588 and the control 582. This, however, can lead to problems in the adjustment of the board to the control unit.

In accordance with the preferred embodiment, the communication board 588 and the machine control unit are adjusted by the machine manufacturer and prepared for connection with the system. For this purpose, it is necessary to agree with the system supplier on a suitable protocol (transmission mode) and a common "object list", whereby the latter defines the information receipts of the signals. This provides the process control computer and the machine control unit with mutual communication capabilities.

We claim:

1. A textile processing plant comprising a plurality of textile material processing regions, the textile material processed in one region being processed for input to another region serially following the one region, each region comprising a group of one or more processing machines, each machine including one or more actuators which actuate selected operational components of a machine, the plant further comprising a master process control computer which receives data representative of an operating condition of the machines and formulates master control instructions from said data, wherein each machine of a group includes a machine control computer which controls operation of the actuators of each machine and a network for bidirectional communication between the master computer and each machine control computer of the group, wherein the master computer sends the master control instructions to the machine control computers via the network, and wherein each machine control computer includes a program for operating a machine independently of the master control instructions and means for evaluating and overriding the master control instructions sent by the master computer according to the independent operating program, the master control instructions being converted by the machine control computers into control signals suitable for receipt by the actuators after evaluation according to the operating program of the machine control computer.

2. The textile processing plant as claimed in claim 1 wherein selected ones of the master control instructions are directly transmitted by the master process control computer to a machine control computer.

3. The textile processing plant as claimed in claim 2, wherein selected other ones of the master control instructions are transmitted indirectly by the master control computer to a machine control computer through a control instruction processing device.

4. The textile processing plant as claimed in claim 1 wherein the connection of the machine control units to the actuators is arranged independently of the communication network between the machine control computer and the process control computer.

5. A textile processing plant as claimed in claim 1 wherein a machine includes one or more safety sensors connected to a machine control computer for signal transmission, an image of a safety condition of the machine being continuously generated by said signal transmission, the independent operating program of the machine control computer being programmed such that the machine control computer carries out a master control instruction received from the master process control computer only if according to the image of the safety condition of the machine said safety condition is suitable for carrying out said instruction.

6. A textile processing plant as claimed in claim 1 wherein the plant includes sensor devices for transmitting signals corresponding to operating conditions of one machine to another associated machine control computer, the machine control computers controlling operation of the machines in the absence of master process control signals communicated from the master computer.

7. The plant of claim 1 wherein the master computer receives the data representative of the operating condition from the machine control computer, the machine control computer receiving signals directly from one or more sensor units which detect an operating condition of the machine, the machine control computer processing the signals and communicating the processed signals to the master computer.

8. The plant of claim 1 wherein the master computer receives the data representative of the operating condition directly from one or more sensor units which detect an operating condition of the machine.

9. A textile spinning mill comprising a plurality of groups of textile processing machines, a master process control computer for controlling at least one group of the textile processing machines of the plant, autonomous machine control computers connected to each machine of each group, and a network for bidirectional communication between the master process control computer and the autonomous machine control computers, the master process control computer transmitting master process control instructions to the autonomous control computers via the network, at least one machine control computer associated with the group of machines including a program for operating an associated machine independently of the master process control instructions, the program including means for monitoring a current operating condition of the machine and means for selectively implementing master control instructions according to the monitored operating condition the machine control computer including means for selectively operating the machine in a first condition according to the program independent of all master process control instructions and in a second condition wherein the machine control computer operates the machine according to the program and the master process control instructions received from the master computer.

10. A textile spinning mill comprising at least one fibre-processing machine having one or more sensors for detecting preselected operating conditions of the machine and a master process control computer for controlling operation of the machine with master instructions, the machine including a machine control computer which operates the machine autonomously from the master process control computer, the machine control computer being connected to and receiving signals from the sensors and including a program which receives and evaluates the master instructions and selectively carries out the master instructions according to an evaluation of the master instructions against the preselected operating conditions detected by the sensors, wherein the master process control computer receives an alarm signal from the machine control computer upon a negative evaluation of wherein the machine control computer receives a predetermined range of values from the master process control computer as operating parameters, such that the machine control computer operates autonomously from the master process control computer according to the operating parameters as defined by the master process control computer.

11. The spinning mill of claim 10 wherein the master computer is connected via a first network to a plurality of fibre-processing machines, the spinning mill further comprising a group of one or more textile processing machines, each processing machine being connected to a processing machine control computer, each processing machine control computer and the master computer being connected to a second network wherein the master computer also sends selected master instructions to each processing machine control computer.

12. A textile spinning mill comprising a plurality of fibre-processing machines, at least two of the machines being concatenated in a chain and a master process control computer, each machine including a machine control computer and sensor units for supplying the machine control computers with data signals representative of a preselected operating condition of a machine, the master computer being connected to the machine control computer of each concatenated machine and sending master instructions to each machine control computer which carry out the master instructions, the machine control computers including a program which evaluates the master instructions against the data signals and selectively implements the master instructions according to the operating conditions represented by the data signals, wherein one or more selected sensor units of one concatenated machine are arranged such that the selected sensor units also supply signals which represent the operating conditions of the one concatenated machine to the machine control unit of another concatenated machine in the chain enabling operation of the concatenated machines without control by the master computer.

13. A textile spinning machine comprising a machine control computer, one or machine operation actuators controlled by the machine control computer and one or more machine operation sensor units which supply signals to the machine control computer representative of an operating condition of the machine, the machine control computer utilizing the signals from the sensors to control the actuators, a master process control computer for formulating and sending master control instructions to the machine control computer, and a communication network connecting the machine control computer and the master computer such that the signals from the sensor units are communicated to the machine control computer and to the master computer from the machine control computer through the network, the master computer utilizing the signals to formulate master instructions and sending the master instructions to the machine control computer for implementation by the machine control computer, the machine control computer selectively implementing the master instructions to control the actuators.

14. A textile processing plant comprising one or more textile material processing regions, each region comprising a group of one or more processing machines, each machine including one or more actuators for actuating selected operational components of a machine and a machine control computer connected to the actuators of the machine for controlling operation of the actuators, the plant further comprising a master process control computer for controlling the machine control computers of at least one group of machines and a network for effecting bidirectional communication between the master computer and each machine control computer, the master computer sending selected master control instructions to the machine control computers, the machine control computers receiving and processing the master control instructions into control signals suitable for receipt by the actuators from the machine control computers, the machine including one or more sensors detecting an operating condition of the of the machine, the sensors sending detection signals to one or both of the machine control computer and the master computer, the master computer receiving the sensor signals directly or indirectly from the machine control computer through the network, the master computer formulating the master instructions based on the operating condition of the machine, the machine control computer including a program for evaluating overriding the master instructions against the operating condition of the machine, the program including means for operating the actuators of the machine independently of the master instructions.

15. The plant of claim 14 wherein each machine includes one or more sensors for detecting a predetermined safety condition of a machine, the sensors being connected to a machine control computer controlling the actuators of the machine and continuously sending signals to the machine control computer for generating an image of the safety condition of the machine in the machine control computer, the machine control computer selectively implementing the master control instructions according to the image of the safety condition generated in the machine control computer.

16. The plant of claim 14 wherein at least one machine control computer includes a program for controlling operations of the actuators of an associated machine independently of the master control instructions, the machine control computer being connected to the actuators of the associated machine independently of the bidirectional communication network between the master computer and the machine control computers.

17. The plant of claim 16 wherein the at least one machine control computer includes an alternative operating mechanism, the alternative operating mechanism being selectively actuatable to operate the machine control computer in a first condition solely in accordance with the program independently of the master control instructions and in a second condition in accordance with the program and the master control instructions.

18. The plant of claim 17 wherein each machine includes one or more sensors for detecting a predetermined safety condition of a machine, the sensors being connected to a machine control computer controlling the actuators of the machine and continuously sending signals to the machine control computer for generating an image of the safety condition of the machine in the machine control computer, the machine control computer selectively implementing the master control instructions according to the image of the safety condition generated in the machine control computer.

19. The plant of claim 16 wherein each machine includes one or more sensors for detecting a predetermined safety condition of a machine, the sensors being connected to a machine control computer controlling the actuators of the machine and continuously sending signals to the machine control computer for generating an image of the safety condition of the machine in the machine control computer, the machine control computer selectively implementing the master control instructions according to the image of the safety condition generated in the machine control computer.

20. The plant of claim 14 wherein at least one group of machines includes at least two machines concatenated for serial processing and transport of textile material from one concatenated machine to another concatenated machine, each concatenated machine including one or more sensors for detecting a predetermined operating condition of an associated machine, the machine control computer of one concatenated machine receiving signals from the sensors associated with the one concatenated machine and generating an image of the operating condition of the one machine, the machine control computer of the one machine further receiving signals from one or more other sensors associated with the other concatenated machine and generating another image of the predetermined operating condition of the other concatenated machine detected by the other sensor.

21. The plant of claim 20 wherein the machine control computer of the one concatenated machine further includes a program for controlling operation of the one concatenated machine in accordance with the images generated.

22. The plant of claim 21 wherein the images being generated are images of the safety condition of the concatenated machines, the machine control computer of the one concatenated machine selectively implementing the master control instructions according to the images of the safety conditions.

23. The plant of claim 21 wherein the images being generated are images of the readiness for transport of textile material from the one concatenated machine to the other concatenated machine.

24. The plant of claim 21 wherein the machine control computers of the concatenated machines each include a program for operating the concatenated machines independently of the master control instructions, the machine control computers of the concatenated machines being connected to the actuators of their associated machines independently of the bidirectional communication networks between the master computers and the machine control computers of the concatenated machines.

25. A textile spinning mill comprising a plurality of groups of textile processing machines, each machine including actuators for operating selected operational components of an associated machine, sensors for detecting preselected operating conditions of an associated machine and a machine control computer for controlling the actuators of an associated machine, the mill including a master control computer for sending master control instructions to the machine control computers through a bidirectional communicative network, the master control instructions instructing the machine control computers to implement control signals for the actuators;

wherein the sensors of at least one machine include sensors for detecting preselected operating conditions of the machine, the operating condition sensors being connected directly to the machine control computer associated with the machine and continuously sending signals to the associated machine control computer which generates an image of the operating condition of the machine from the operating condition signals;

the associated machine control computer including a program for implementing the master control instructions subordinate to the operating condition image generated in the machine control computer.

26. The spinning mill of claim 25 wherein the sensors of the at least one machine include one or more safety condition sensors the machine control computer generating an image of the safety condition of the machine.

27. The spinning mill of claim 25 wherein the associated machine control computer of the at least one machine includes a program for controlling operation of the actuators of the machine independently of the master control instructions.

28. The spinning mill of claim 27 wherein the machine control computer of the at least one machine includes an alternative operating mechanism, the alternative operating mechanism being selectively actuatable to operate the machine control computer in a first condition solely in accordance with the independent operation program and in a second condition in accordance with the independent operation program and the master control instructions.

29. The spinning mill of claim 28 wherein signals from one or more sensors of the at least one machine are communicated to the master computer when the machine control computer operates in the first condition.

30. The spinning mill of claim 29 wherein the sensors of the at least one machine include one or more non-safety condition sensors communicating data signals to the master control computer independently of the machine control computer.

31. The spinning mill of claim 28 wherein the sensors of the at least one machine include one or more non-safety condition sensors communicating data signals to the master control computer independently of the machine control computer.

* * * * *